US010513375B2

(12) United States Patent
Karll

(10) Patent No.: US 10,513,375 B2
(45) Date of Patent: Dec. 24, 2019

(54) METAL CHILD RESISTANT CONTAINER

(71) Applicant: Nicholas Patrick Karll, Los Angeles, CA (US)

(72) Inventor: Nicholas Patrick Karll, Los Angeles, CA (US)

( * ) Notice: Subject to any disclaimer, the term of this patent is extended or adjusted under 35 U.S.C. 154(b) by 0 days.

(21) Appl. No.: 16/381,904

(22) Filed: Apr. 11, 2019

(65) Prior Publication Data

US 2019/0315535 A1 Oct. 17, 2019

Related U.S. Application Data

(63) Continuation-in-part of application No. 15/951,482, filed on Apr. 12, 2018, and a continuation-in-part of application No. 16/011,267, filed on Jun. 18, 2018, which is a continuation-in-part of application No. 15/951,482, filed on Apr. 12, 2018.

(51) Int. Cl.

| | |
|---|---|
| ***B65D 50/00*** | (2006.01) |
| ***B65D 50/04*** | (2006.01) |
| ***B65D 50/02*** | (2006.01) |
| ***B65D 25/54*** | (2006.01) |
| *B65D 51/18* | (2006.01) |

(52) U.S. Cl.

CPC ..... *B65D 50/041* (2013.01); *B65D 25/54* (2013.01); *B65D 51/18* (2013.01); *B65D 2215/02* (2013.01)

(58) Field of Classification Search

CPC .... B65D 7/04; B65D 50/041; B65D 50/0068; B65D 25/54; B65D 51/20; B65D 2251/0018; B65D 2251/0093; B65D 1/0207; B65D 2215/02; A61J 1/1437; A61J 1/2065

USPC ..... 215/220, 221, 321, 206

See application file for complete search history.

(56) References Cited

U.S. PATENT DOCUMENTS

| | | | |
|---|---|---|---|
| 1,356,344 | A | 10/1920 | Dister |
| 2,172,864 | A | 9/1939 | Calva |
| 2,186,338 | A | 1/1940 | Mills |
| 2,359,639 | A | 10/1944 | Hanahan |

(Continued)

FOREIGN PATENT DOCUMENTS

| | | |
|---|---|---|
| GB | 1377785 | 12/1974 |

OTHER PUBLICATIONS

Tin Canna (TM) website information Accessed Sep. 19, 2019, https://tin-canna.com/tin-canna/ Inventor Nicholas Patrick Karll listed as Founder and CEO—Eco Packaging Solutions (Year: 2019).*

(Continued)

*Primary Examiner* — Gideon R Weinerth

(74) *Attorney, Agent, or Firm* — Mackey Law Firm PLLC

(57) ABSTRACT

A child resistant container can include a container body, a closed base, an open top, an exterior and a cap assembly configured to couple to the container body for closing the container. A cap assembly can include an inner cap configured to couple to a container body and an outer cap coupled to the inner cap. A first coupler can be coupled to the inner cap and a second coupler can be coupled to the outer cap and configured to optionally engage the first coupler. An outer cap can be configured to rotate relative to an inner cap when the outer cap is in one or more positions and to engage the inner cap when the outer cap is in one or more other positions. A child resistant container can be made from recyclable metal.

19 Claims, 11 Drawing Sheets

(56) References Cited

U.S. PATENT DOCUMENTS

| | | | | | |
|---|---|---|---|---|---|
| 2,864,519 | A | * | 12/1958 | Crabbe | B65D 55/02 215/217 |
| 2,980,274 | A | | 4/1961 | Gould | |
| 3,055,524 | A | | 9/1962 | Glasbrenner | |
| 3,343,697 | A | * | 9/1967 | Roberts | B65D 50/041 215/220 |
| 3,396,864 | A | * | 8/1968 | Jones | B65D 50/068 215/215 |
| 3,472,410 | A | * | 10/1969 | Turner | B65D 50/041 215/206 |
| 3,472,411 | A | * | 10/1969 | Turner | B65D 50/041 215/220 |
| 3,638,819 | A | | 2/1972 | Roy | |
| 3,679,085 | A | * | 7/1972 | Gach | B65D 50/041 215/220 |
| 3,764,033 | A | * | 10/1973 | Smith | B65D 50/041 215/201 |
| D232,916 | S | | 9/1974 | Bettonica | |
| 3,843,008 | A | * | 10/1974 | Colella | B65D 50/068 215/215 |
| 3,926,328 | A | * | 12/1975 | Cistone | B65D 50/041 215/220 |
| 3,946,890 | A | * | 3/1976 | Scuderi | B65D 50/041 215/220 |
| 4,004,704 | A | * | 1/1977 | Hilaire | B65D 50/041 215/220 |
| 4,011,960 | A | | 3/1977 | Mauvernay et al. | |
| 4,223,799 | A | * | 9/1980 | Eyster | B60K 15/0406 215/201 |
| 4,241,840 | A | | 12/1980 | Willis | |
| 4,284,201 | A | * | 8/1981 | Nixon | B65D 50/041 215/220 |
| 4,319,690 | A | * | 3/1982 | Birrell | B65D 50/041 215/220 |
| 4,410,098 | A | * | 10/1983 | Dubs | B65D 50/041 215/220 |
| 4,433,789 | A | * | 2/1984 | Gibilisco | B65D 50/041 215/220 |
| 4,957,210 | A | * | 9/1990 | Kusz | B65D 50/041 215/220 |
| 5,280,842 | A | * | 1/1994 | Koo | B65D 50/041 215/220 |
| 5,316,161 | A | * | 5/1994 | Gargione | B65D 50/041 215/220 |
| 5,370,251 | A | | 12/1994 | Buono | |
| 5,437,382 | A | * | 8/1995 | Gluckman | B65D 50/067 215/204 |
| 5,524,779 | A | * | 6/1996 | Faile | B65D 50/041 215/207 |
| 6,206,216 | B1 | * | 3/2001 | Stalions | B65D 50/041 215/220 |
| 7,337,929 | B2 | | 3/2008 | Winckels | |
| D565,412 | S | | 4/2008 | Fuller | |
| D577,290 | S | | 9/2008 | Moretti | |
| D578,891 | S | | 10/2008 | Canamasas Puigbo | |
| 8,056,742 | B2 | * | 11/2011 | Brozell | B65D 50/041 215/220 |
| 8,863,947 | B2 | | 10/2014 | Sibley | |
| D797,559 | S | | 9/2017 | Lerman | |
| 9,878,821 | B2 | | 1/2018 | Sibley | |
| 10,232,990 | B2 | | 3/2019 | Sang | |
| 2004/0262251 | A1 | * | 12/2004 | Tauber | B65D 50/041 215/220 |
| 2007/0110928 | A1 | | 5/2007 | Bried et al. | |
| 2016/0106149 | A1 | | 4/2016 | Potter et al. | |
| 2016/0176591 | A1 | * | 6/2016 | Thomas | B65D 50/041 215/218 |
| 2017/0113851 | A1 | | 4/2017 | Martin et al. | |
| 2017/0355495 | A1 | | 12/2017 | Martin et al. | |
| 2018/0319556 | A1 | | 11/2018 | Straughan | |

OTHER PUBLICATIONS

Written Opinion of the International Searching Authority and International Search Report dated Aug. 15, 2019 for International Application No. PCT/US2019/027049.

* cited by examiner

METAL CHILD RESISTANT CONTAINER

CROSS REFERENCE TO RELATED APPLICATIONS

This Application is a continuation-in-part of U.S. patent application Ser. No. 15/951,482 filed on Apr. 12, 2018, and is a continuation-in-part of U.S. patent application Ser. No. 16/011,267 filed on Jun. 18, 2018, which is a continuation-in-part of U.S. patent application Ser. No. 15/951,482 filed on Apr. 12, 2018, the entire contents of which are hereby incorporated by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The present disclosure relates generally to containers and more specifically relates to child resistant metal containers.

Description of the Related Art

Some jurisdictions have enacted laws requiring products that are susceptible to dangerous misuse by children to be sold by retailers in child resistant packaging. Examples of such products include medicines, pills and gels, among others. Some child resistant packaging, such as one-time opening (or single use) clamshell designs and blister packaging, cannot be resealed after the substance or contents is initially accessed. Other child resistant packaging products may be resealable, such as plastic pill bottles, but cannot necessarily utilize modern preservation techniques to extend the shelf life of the contained substance. Many consumers are also concerned about the state of the environment and prefer product packaging that can be recycled easily or more readily. Plastic pill bottles and other packaging may be made of materials that are not accepted at many recycling processing plants or that have a limited lifecycle. Another concern of consumers is that plastics are known to leach chemicals into the products they come into contact with. For things such as medication this may be a big concern, including for people with compromised immune systems.

Some products require or are more suited to containers made from materials other than plastic, such as metal. For instance, metal containers may be used for products that include combustibles or flammable solvents like alcohols, toluene, or hexane. Chlorinated solvents are another type of product that may be best suited for metal containers. Metal containers may also be used for products that need more protection from ultraviolet (UV) light degradation than may be provided by plastic or translucent containers.

While known containers may be suitable for some uses, a need exists in the art for improved containers that can be made from recyclable metal, are cost effective and user friendly, and that can meet the requirements of child resistant packaging and related certification requirements. A metal child resistant container can also have other advantages over some existing containers, such as being better suited than a plastic pill bottle for laser etched or engraved tracking information. In the case of etching or engraving, a substance like plastic can make it easy for tracking or other information to be scratched off or distorted in other ways that make tracking information or other information indecipherable.

The present disclosure is directed to improved containers that can at least partially minimize or eliminate one or more shortcomings of known containers. Embodiments of the disclosure can be meet the requirements for child resistant packaging and can be made of recyclable metal alloy widely accepted by recycling processors. Embodiments of the disclosure can differ from current products on the market in that they can be opened and closed multiple times without loss of function, are easily recyclable, and can preserve the contents of the container better than similar products.

Embodiments of the disclosure differ from other childproof packages on the market in that they can be used to store a substance alone (i.e., absent other packaging) or any of various pre-packaged products whose original packaging may not come equipped with a childproofing device, while also being all metal and 100% recyclable. Embodiments of the disclosure can be or include a child resistant metal container that can be resealed, recycled, and is capable of utilizing one or more preservation techniques to suitably store a contained substance longer than other containers.

BRIEF SUMMARY OF THE INVENTION

A child resistant container can include a container body having a central longitudinal axis, a closed base, an open top and an exterior wall, and a cap assembly configured to couple to the container body for closing the container. A cap assembly can include an inner cap configured to couple to a container body and an outer cap coupled to the inner cap, each of the inner and outer caps having a top, a first coupler coupled to the inner cap, and a second coupler coupled to the outer cap and configured to optionally engage the first coupler. An inner cap can be disposed at least partially within an outer cap. At least a portion of the top of an outer cap can be configured to optionally move among first and second or other positions relative to the inner cap, such as along the central longitudinal axis or otherwise. A first or other position can be farther away from a top of the inner cap than a second or other position. An outer cap can be configured to rotate relative to an inner cap, such as when the top of the outer cap is in one or more positions, and a second or other coupler can be configured to engage a first or other coupler, such as when a top of an outer cap is in a second or other position.

A container can include a plate disposed at least partially between the top of the inner cap and the top of the outer cap, and a second or other coupler can be coupled to the plate. One or more plates can be rotationally fixed relative to an outer cap or other component or portion of a container. A top of an outer cap can be in a second or other position and an outer cap can be adapted to rotate relative to an inner cap, such as before a second or other coupler engages a first or other coupler, which can include rotating a partial rotation such as less than 45 degrees or less than 90 degrees or less than 180 degrees or otherwise. At least a portion of a top or other portion of an outer cap can be configured to elastically deform and a first or other position relative to a top of an inner cap can be a rest position of the top or other portion of an outer cap. At least a portion of an inner cap can be retained within an outer cap, such as by a wholly or partially radially inwardly rolled or otherwise disposed lip of the outer cap. An inner cap can include a radially outwardly rolled or otherwise disposed lip and can have a height or other dimension less than, greater than or equal to a height or other dimension of an outer cap. A radially outwardly rolled lip of an inner cap can be configured to at least optionally contact a radially inwardly rolled lip of an outer cap.

A first or other coupler can include a groove and a second or other coupler can include a tongue configured to engage the groove. A first or other coupler can include a plurality of grooves and a second or other coupler can include a plurality of tongues configured to engage corresponding ones of the plurality of grooves. A number of grooves, tongues or other couplers can be the same or different. A first or other coupler can include a plurality of grooves and a second or other coupler can include a tongue adapted to engage two or more of the plurality of grooves. A first or other coupler can include a plurality of grooves that extend radially outwardly from a central longitudinal axis or other point or reference. Two or more of a plurality of grooves can intersect or not intersect. Two or more of a plurality of grooves can be at least partially perpendicular to one another. A first or other coupler can include a groove having a rotationally leading side and a rotationally trailing side in a clockwise or other direction and a second coupler can include a tongue having a rotationally leading side and a rotationally trailing side in a clockwise or other direction. A leading or other side of a tongue can be configured to engage a leading or other side of a groove, such as for coupling a cap assembly to a container body. A trailing or other side of a tongue can be configured to engage a trailing or other side of a groove, such as for uncoupling a cap assembly from a container body.

Leading or other sides of a tongue and/or a groove can be disposed at a first or other angle(s) and trailing sides of a tongue and/or a groove can be disposed at a second or other angle(s). In at least one embodiment, first and second angles, or other angles, can be the same. In at least one embodiment, first and second angles, or other angles, can be different. In at least one embodiment, a first angle can be 60 degrees relative to horizontal and a second angle can be 65 degrees relative to horizontal. A first or other coupler can include two or more grooves and a second or other coupler can be configured to skip out of one or more grooves and into one or more grooves, such as when the cap assembly reaches a fully closed position. One or more couplers can be adapted for at least partially minimizing a chance of overtightening. One or more couplers can be adapted for signaling or indicating to a user that a container is fully or otherwise closed, such as audibly or mechanically or both, which can include generating one or more sounds, vibrations, or other mechanical attributes or indicators, such as by way of skipping or another noticeable cooperation or result of cooperation among one or more container components.

In at least one embodiment, a child resistant container can include a container body having a central longitudinal axis, a closed base, an open top and an exterior wall, and a cap assembly configured to couple to the container body for closing the container. A cap assembly can include an inner cap configured to couple to the container body and an outer cap coupled to the inner cap, each of the inner and outer caps having a top, a first coupler coupled to the inner cap, wherein the first coupler can include a plurality of grooves that extend radially outwardly from the central longitudinal axis, and a second coupler coupled to the outer cap and configured to optionally engage the first coupler, wherein the second coupler can include a plurality of tongues, wherein the inner cap can be disposed at least partially within the outer cap and can include a radially outwardly rolled lip that can be retained within the outer cap by a radially inwardly rolled lip of the outer cap, wherein at least a portion of the top of the outer cap can be configured to optionally move among first and second positions relative to the inner cap along the central longitudinal axis, the first position being further away from the top of the inner cap than the second position, wherein the outer cap can be configured to rotate relative to the inner cap when the top of the outer cap is in the first position and the radially inwardly rolled lip of the outer cap is in contact with the radially outwardly rolled lip of the inner cap, and wherein the second coupler can be configured to engage the first coupler when the top of the outer cap is in the second position.

DETAILED DESCRIPTION

Figure 1:
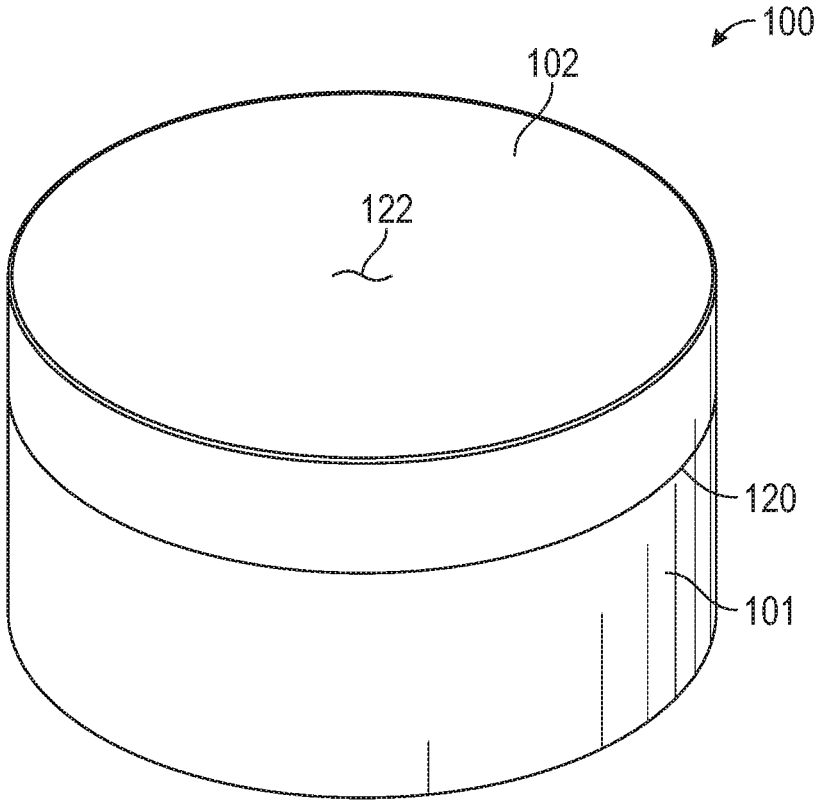
FIG. 1 is a perspective view of one of many embodiments of a child resistant container according to the disclosure.

The Figures described above and the written description of specific structures and functions below are not presented to limit the scope of what Applicant has invented or the scope of the appended claims. Rather, the Figures and written description are provided to teach any person skilled in the art to make and use the invention(s) for which patent protection is sought. Those skilled in the art will appreciate that not all features of a commercial embodiment of the disclosure are described or shown for the sake of clarity and understanding. Persons of skill in this art will also appreciate that the development of an actual commercial embodiment incorporating aspects of the present disclosure can require numerous implementation-specific decisions to achieve the developer's ultimate goal for the commercial embodiment(s). Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts nevertheless would be a routine undertaking for those of skill in the art having the benefits of this disclosure. The embodiment(s) disclosed and taught herein are susceptible to numerous and various modifications and alternative forms. The use of a singular term, such as, but not limited to, "a," is not intended as limiting of the number of items. The use of relational terms, such as, but not limited to, "top," "bottom," "left," "right," "upper," "lower," "down," "up," "side," "first," "second," ("third" et seq.), "inlet," "outlet" and the like are used in the written description for clarity in specific reference to the Figures and are not intended to limit the scope of the disclosure or the appended claims unless otherwise indicated. The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one member with another in a unity fashion. The coupling can occur in any direction, including rotationally. The terms "include" and "such as" are illustrative and not limitative, and the word "can" means "can, but need not" unless otherwise indicated. Notwithstanding any other language in the present disclosure, the embodiment(s) shown in the drawings are examples presented for purposes of illustration and explanation and are not the only embodiments of the subject(s) hereof.

Applicant has created systems and methods for improved child resistant containers. In at least one embodiment, a container according to the disclosure can be configured for a user to apply pressure, which can include unidirectional or bidirectional (e.g., opposing) pressure, to the top and/or bottom of the device to engage couplers on one or more caps or other components, such as on outer and inner caps, to lock or otherwise couple for opening and/or closing the container. Once engaged, a user can twist one or more container components and thereby twist one or more other container components, and in at least one embodiment, place complimentary angled screw threads on an interior wall of a cap and an exterior wall of a container body into threading communication with each other for opening and/or closing a container or one or more caps relative to a container body. When opposing force or pressure is applied to a container cap and body and couplers or indentations of a plate or cap are aligned with those of another cap, one or more components can depress, bend or move and a user can twist a container cap and/or body for causing one or more threads to catch and separate the lid from the body or attach it thereto. In the absence of such user force or pressure, an exterior container lid can be configured to spin about an inner cap without moving or rotating it. In at least one embodiment, a container can be at least partially air tight when closed, which can allow the container to safely or otherwise satisfactorily store its contents for an extended period of time. In at least one embodiment, gas inside a container can be altered or treated to have a less reactive gas inside, which can help prevent decay or otherwise preserve a state of a substance stored within the container. One or more seals, such as a high barrier sealing or lidding film, can be affixed on the top or another portion of a container body, such as for maintaining a specific or desired atmosphere even after the lid is removed. This can allow, for example, for the contents of a container to be visually inspected without disturbing the atmosphere within the container. Once the seal is initially removed, the atmosphere of the container may no longer be contained or maintained in the same state, but in at least one embodiment a container according to the disclosure can be adapted for at least partially preserving or maintaining such an atmosphere. In at least one embodiment, a container according to the disclosure can be made largely or completely out of metal. Exemplary metals can include steel, tin, copper, aluminum, and alloys thereof, separately or in combination, in whole or in part. A container according to the disclosure can, in at least one embodiment, prevent or minimize BPA leaching or chemical leaching into a stored product. A container according to the disclosure can be configured for having track and trace information laser etched or otherwise applied onto or into the container in a manner not easily removed or altered. In at least one embodiment, a container according to the disclosure can be at least substantially completely recyclable.

Figure 2A:
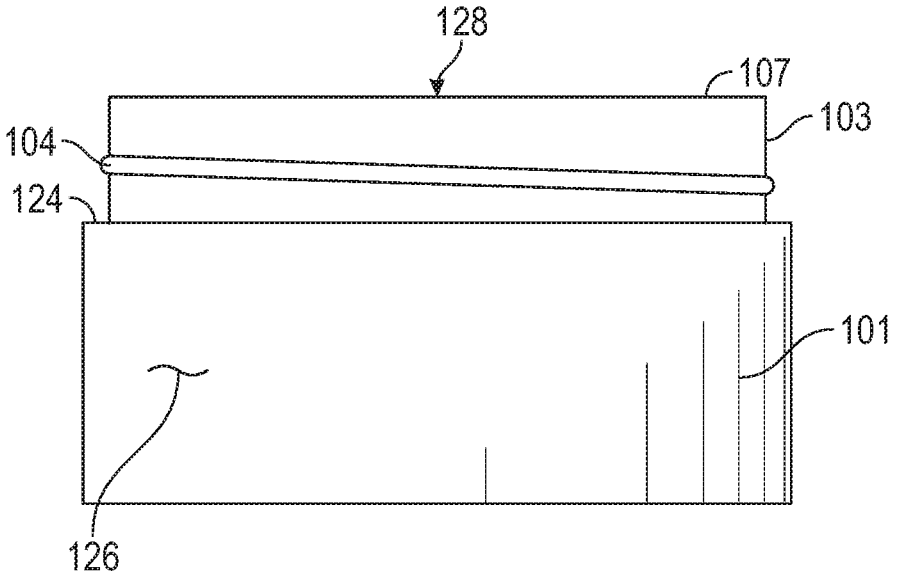
FIG. 2A is a side view of the container of FIG. 1 with the lid removed.
Figure 2B:
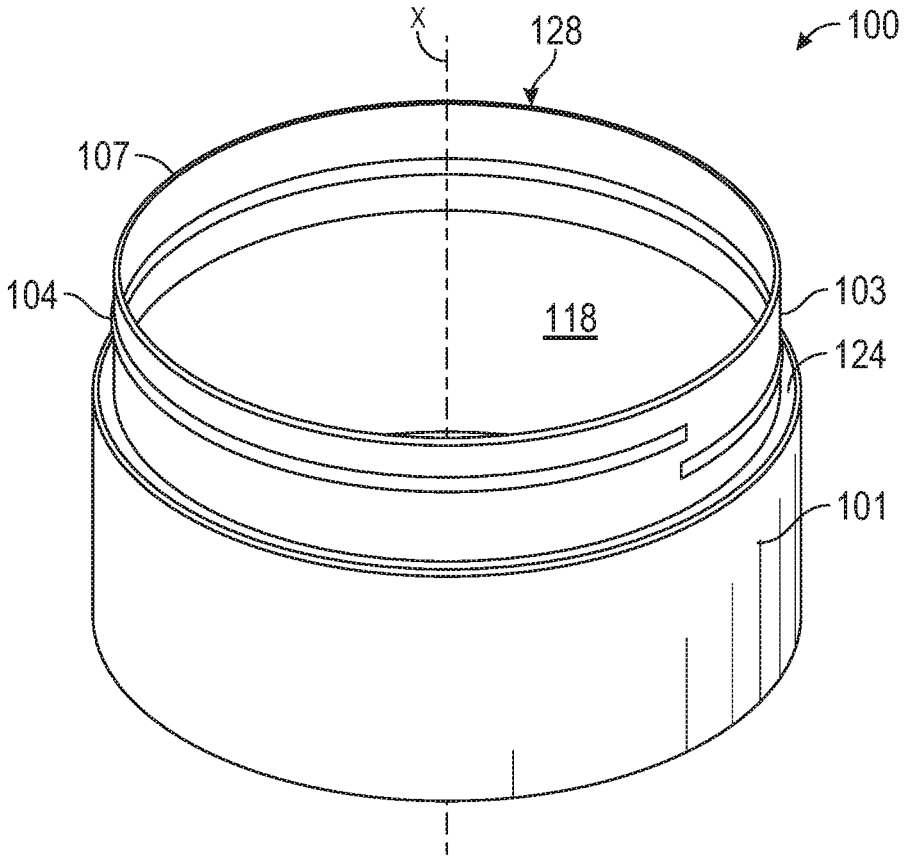
FIG. 2B is a perspective view of the container of FIG. 1 with the lid removed.
Figure 3A:
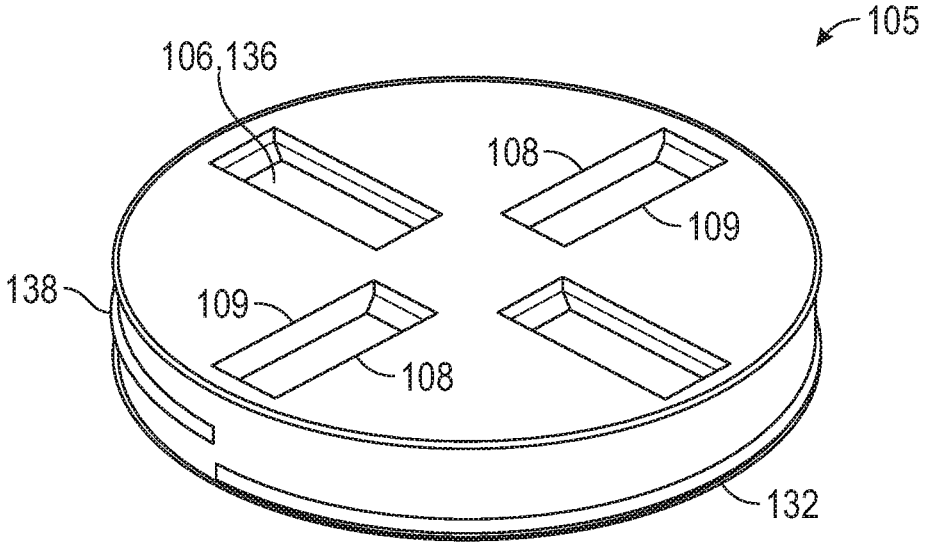
FIG. 3A is a top perspective view of one of many embodiments of an inner cap according to the disclosure.
Figure 3B:
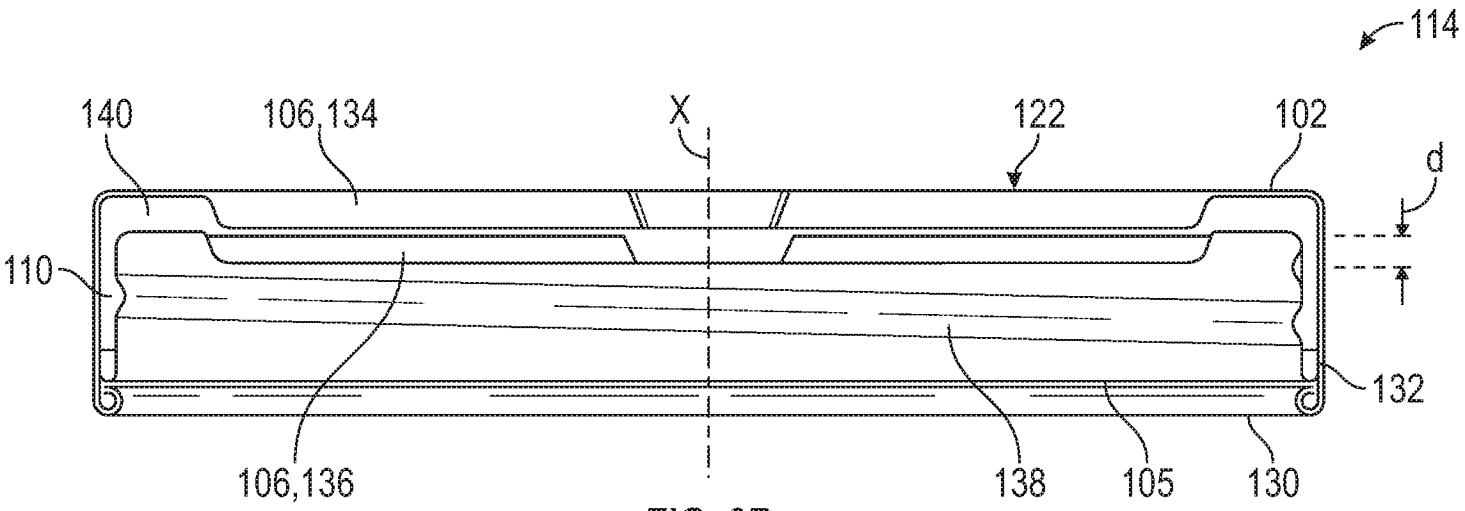
FIG. 3B is a cross-sectional side view of one of many embodiments of a cap assembly in an uncoupled position according to the disclosure.
Figure 3C:
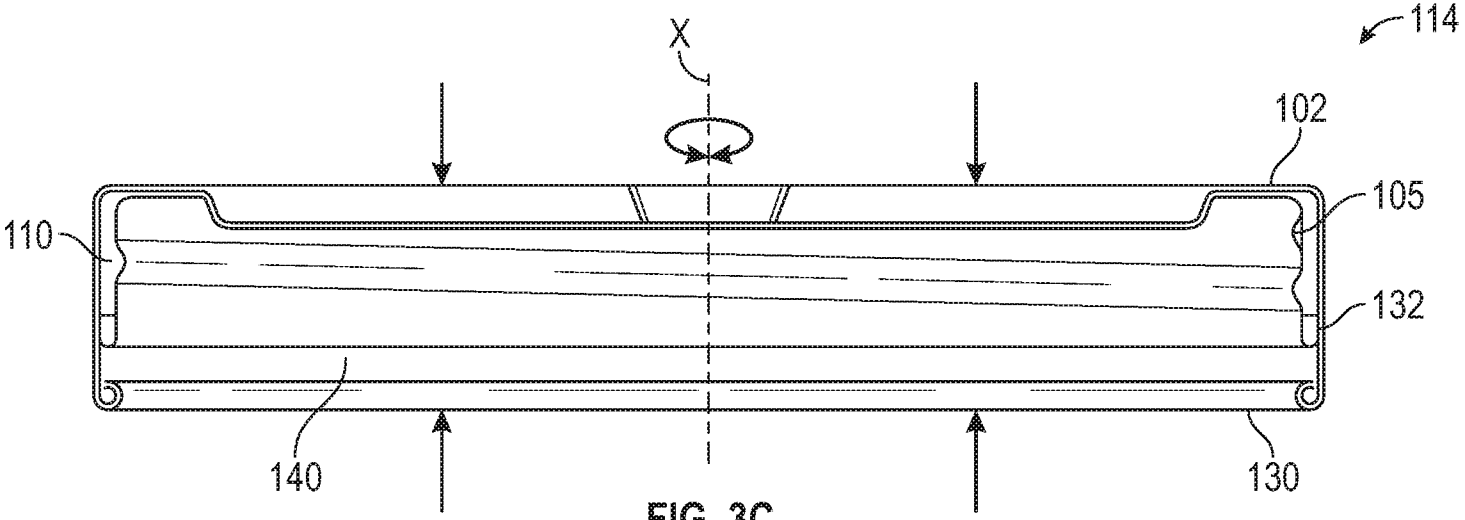
FIG. 3C is a cross-sectional side view of the cap assembly of FIG. 3B in a coupled position.
Figure 3D:
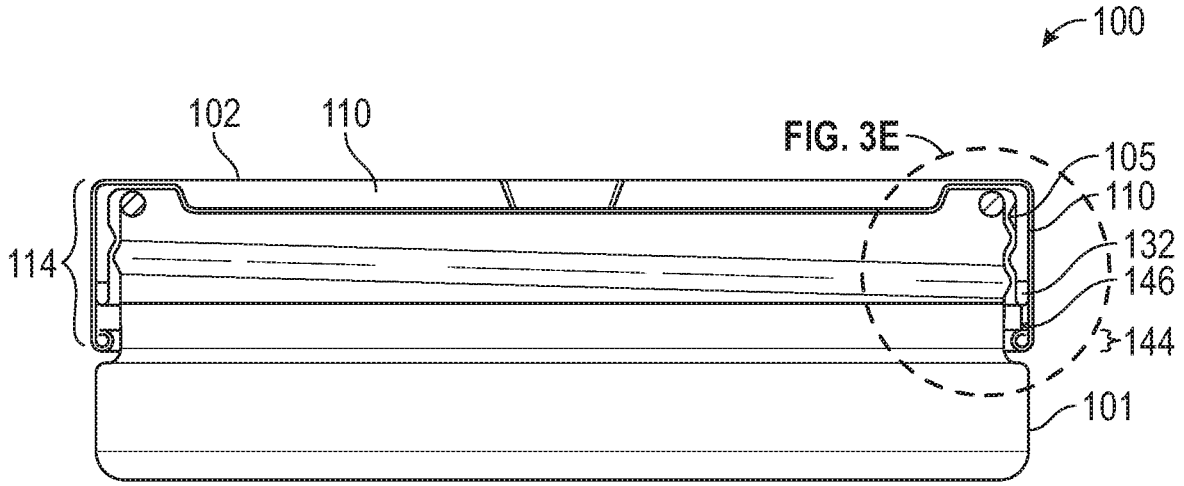
FIG. 3D is a cross-sectional side view of one of many embodiments of a cap assembly coupled to a container body according to the disclosure.
Figure 3E:
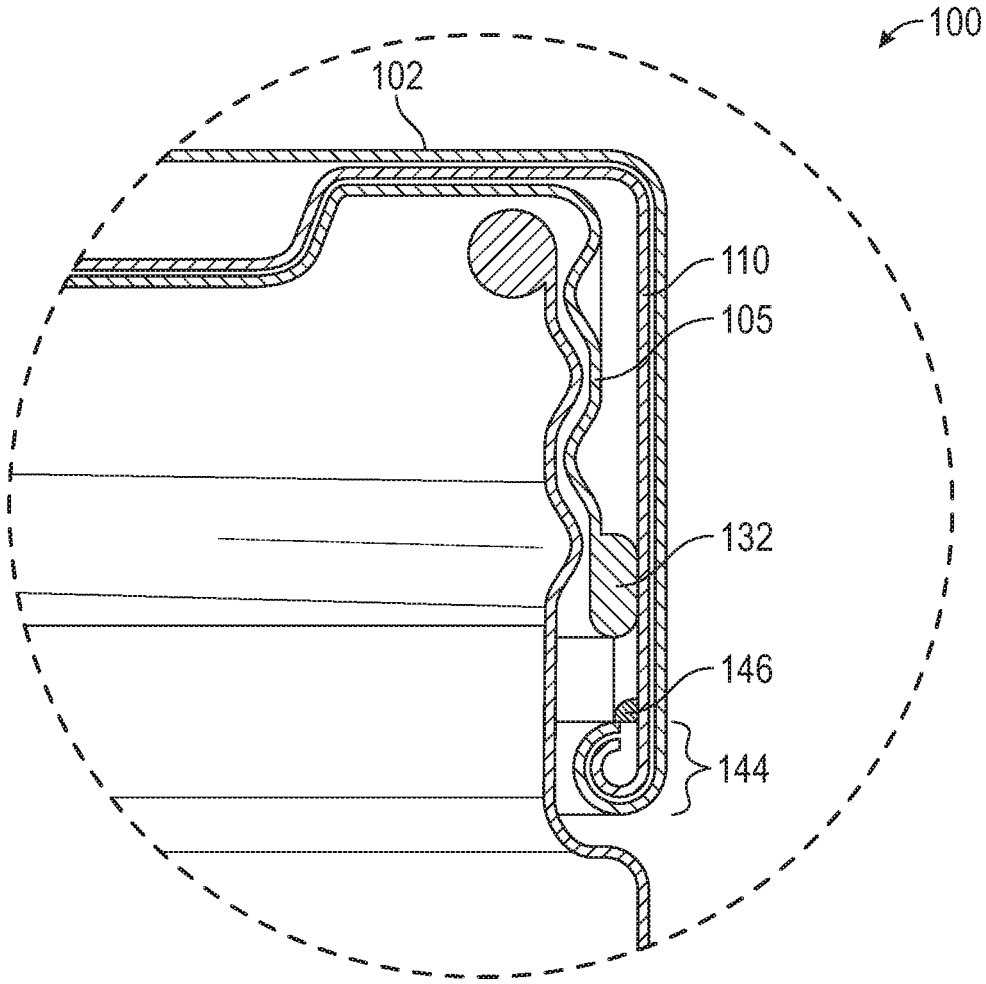
FIG. 3E is a detail view of a portion of FIG. 3D.
Figure 4:
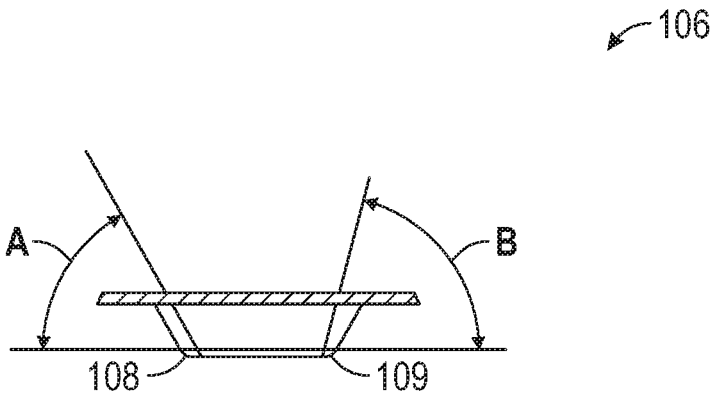
FIG. 4 is a cross-sectional detail side view of one of many embodiments of an indentation according to the disclosure.
Figure 5A:
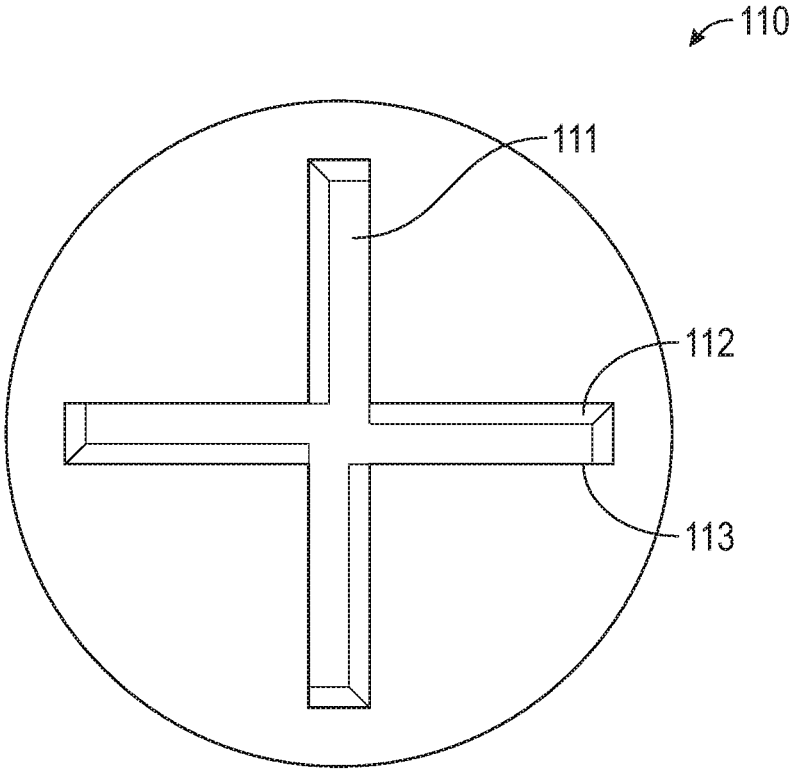
FIGS. 5A and 5B are top views of two of many embodiments of a center plate according to the disclosure.
Figure 5B:
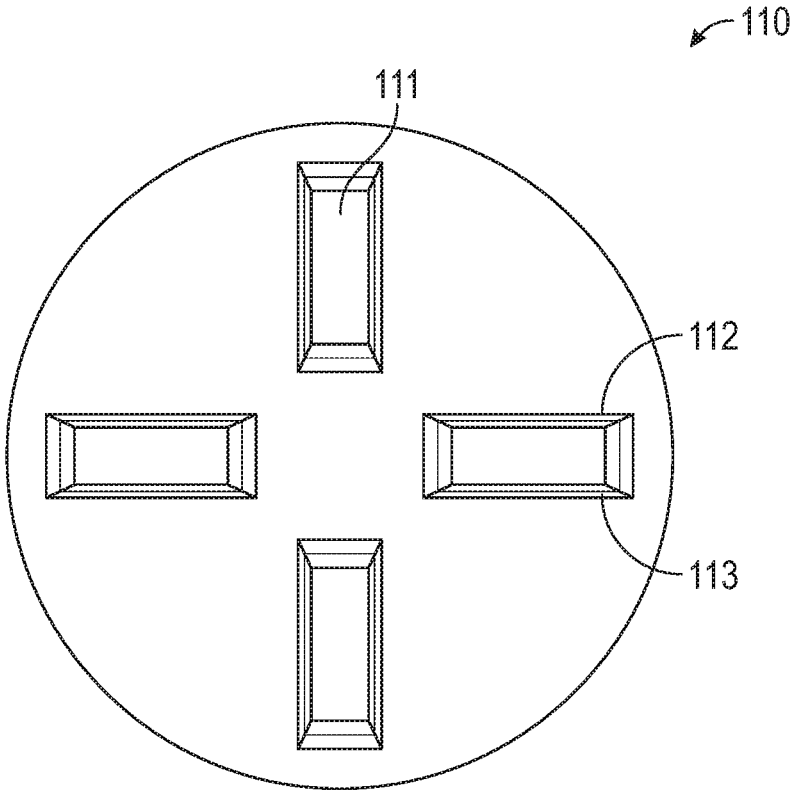
Figure 6:
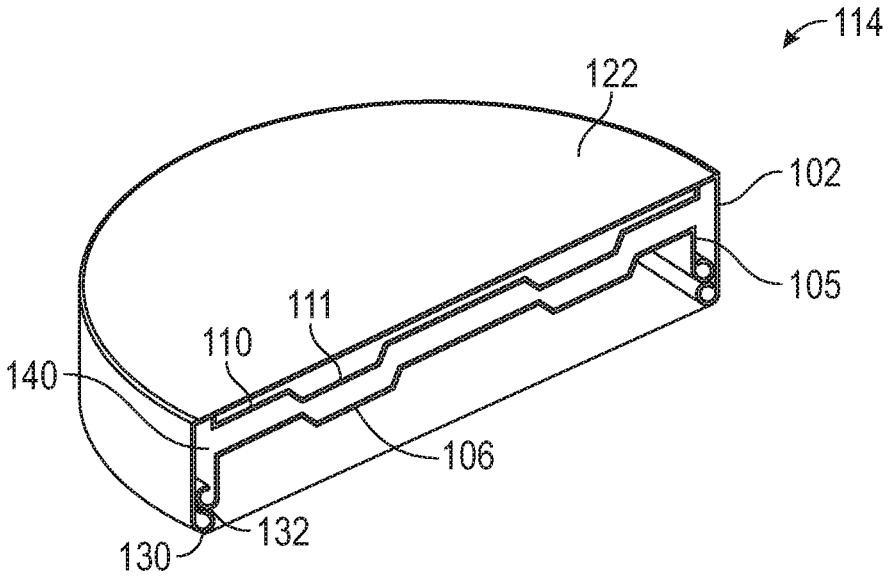
FIG. 6 is a cross-sectional perspective view of another of many embodiments of a cap assembly in an uncoupled position according to the disclosure.
Figure 7:
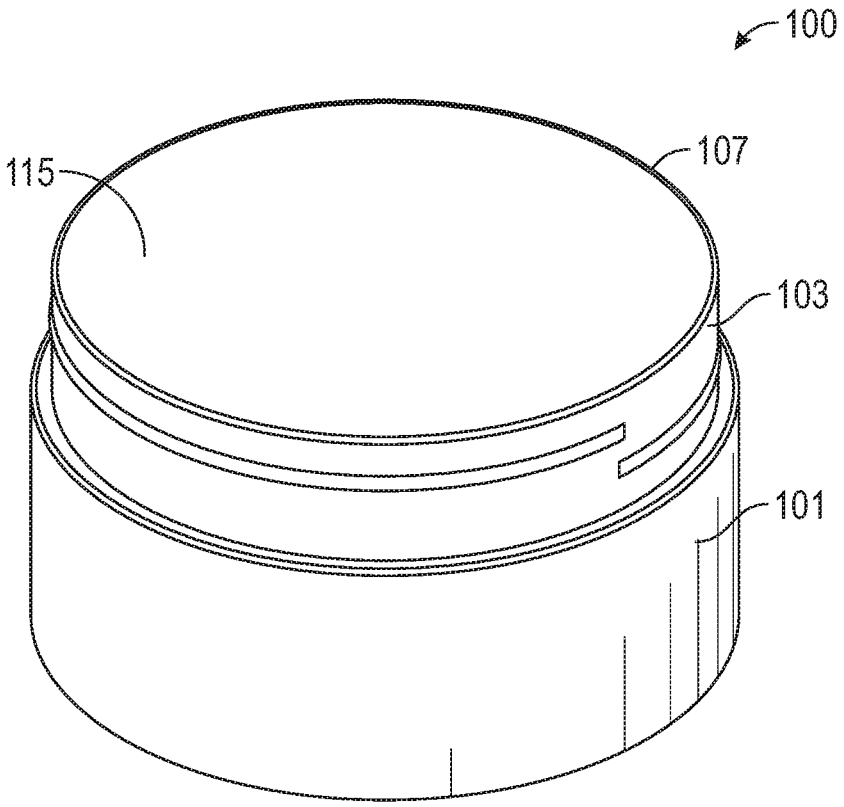
FIG. 7 is a perspective view of one of many embodiments of a child resistant container having a seal according to the disclosure.
Figure 8A:
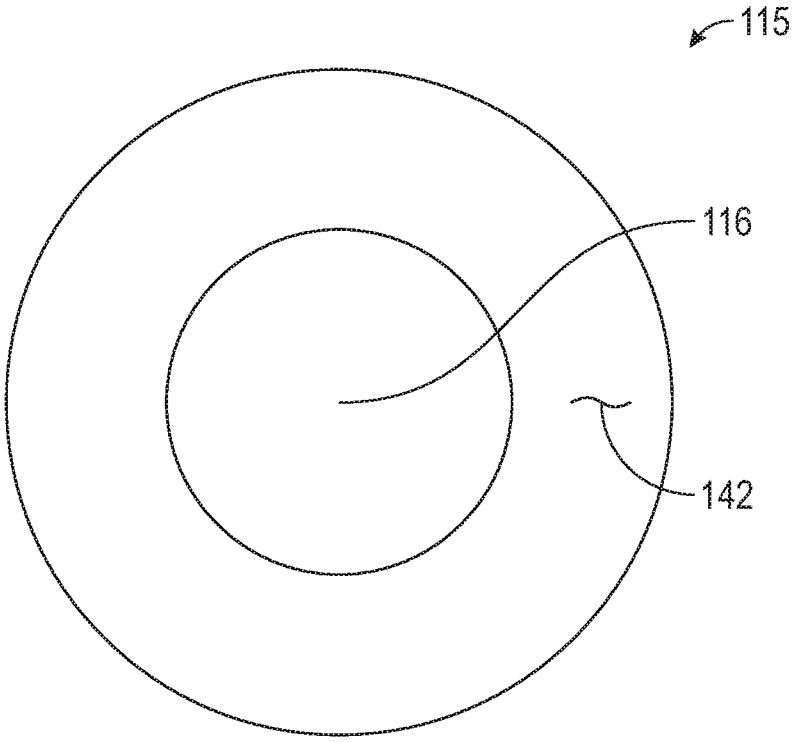
FIGS. 8A, 8B and 8C are bottom views of three of many embodiments of a seal having desiccant and/or oxygen scavenging material according to the disclosure.
Figure 8B:
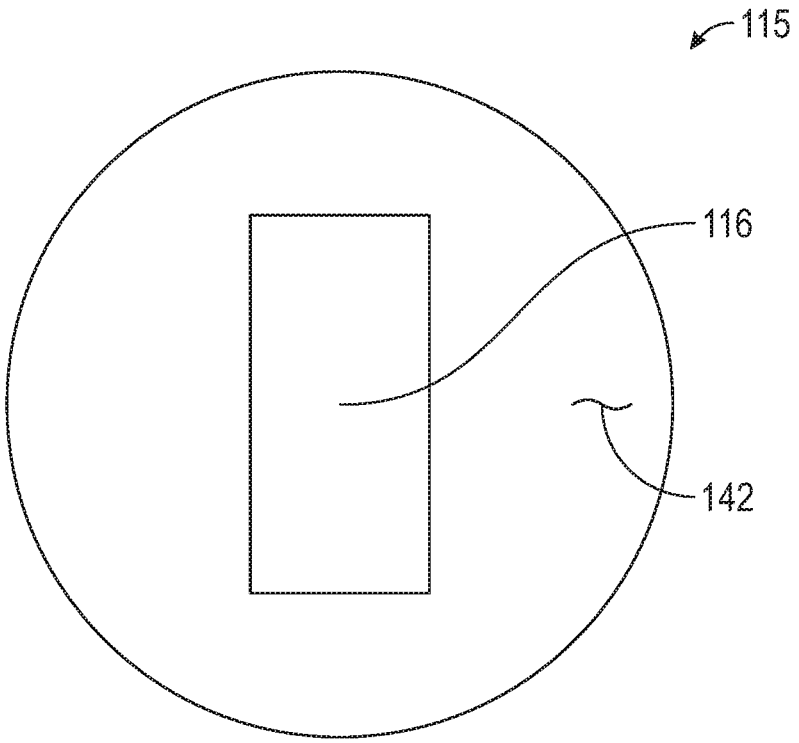
Figure 8C:
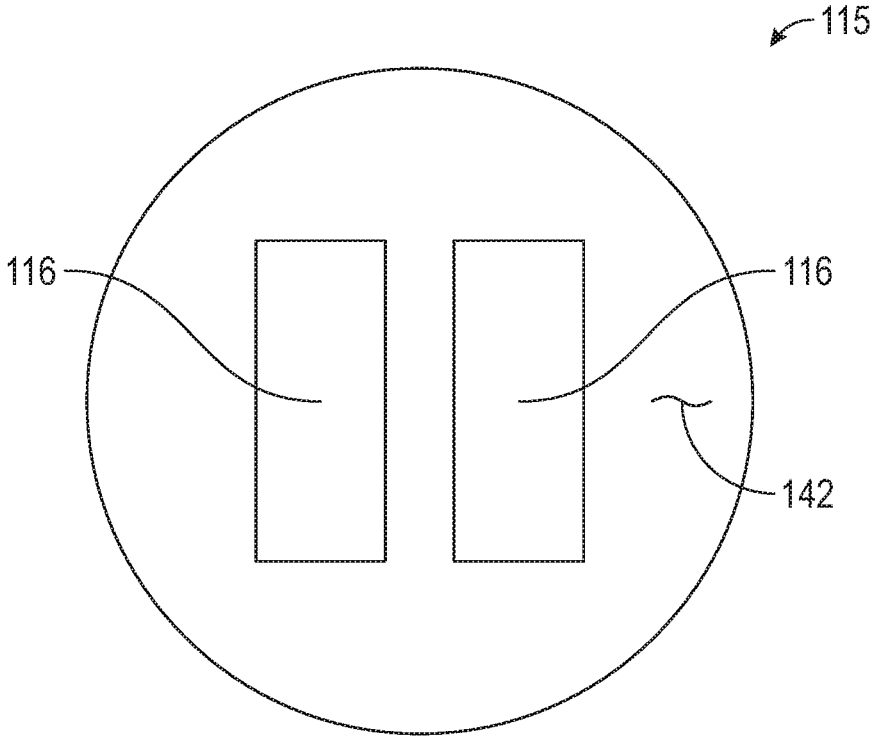
Figure 9A:
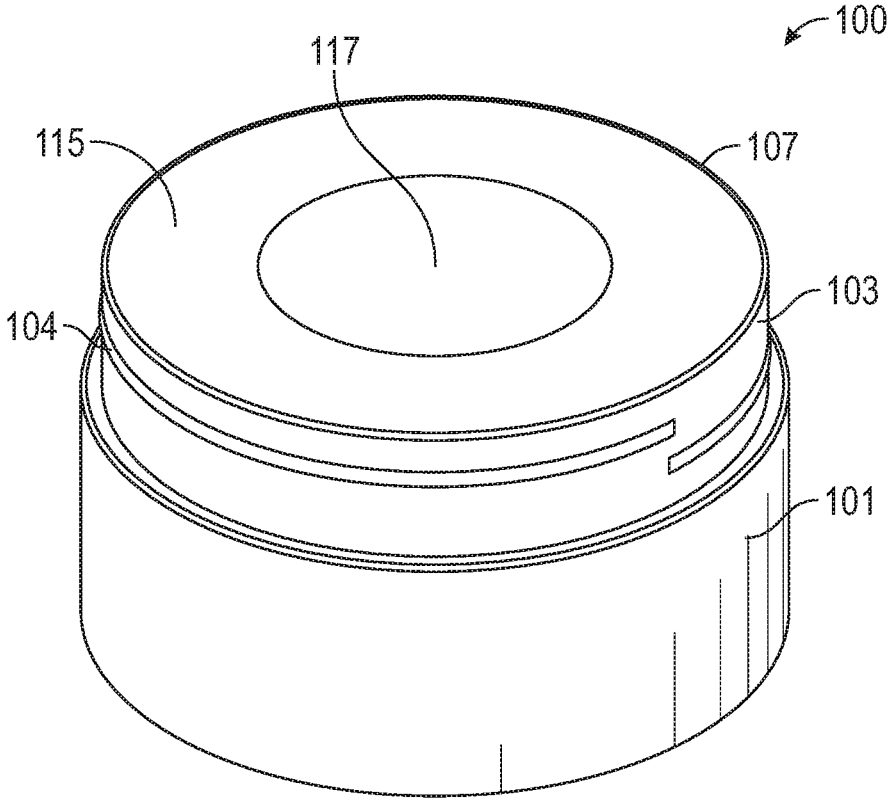
FIG. 9A is a perspective view of one of many embodiments of a child resistant container having a window according to the disclosure.
Figure 9B:
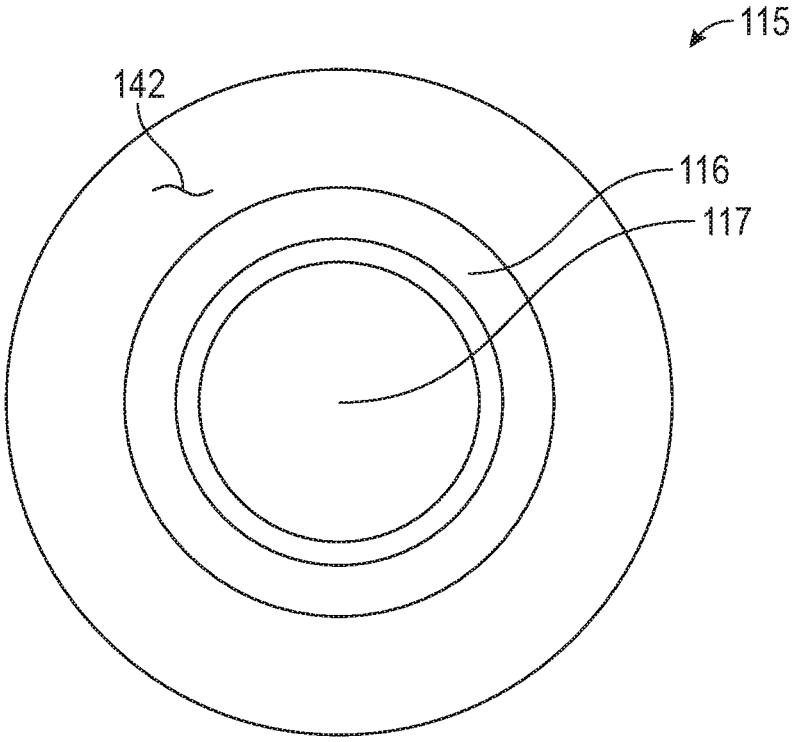
FIG. 9B is a bottom view of the seal of FIG. 9A.
Figure 10:
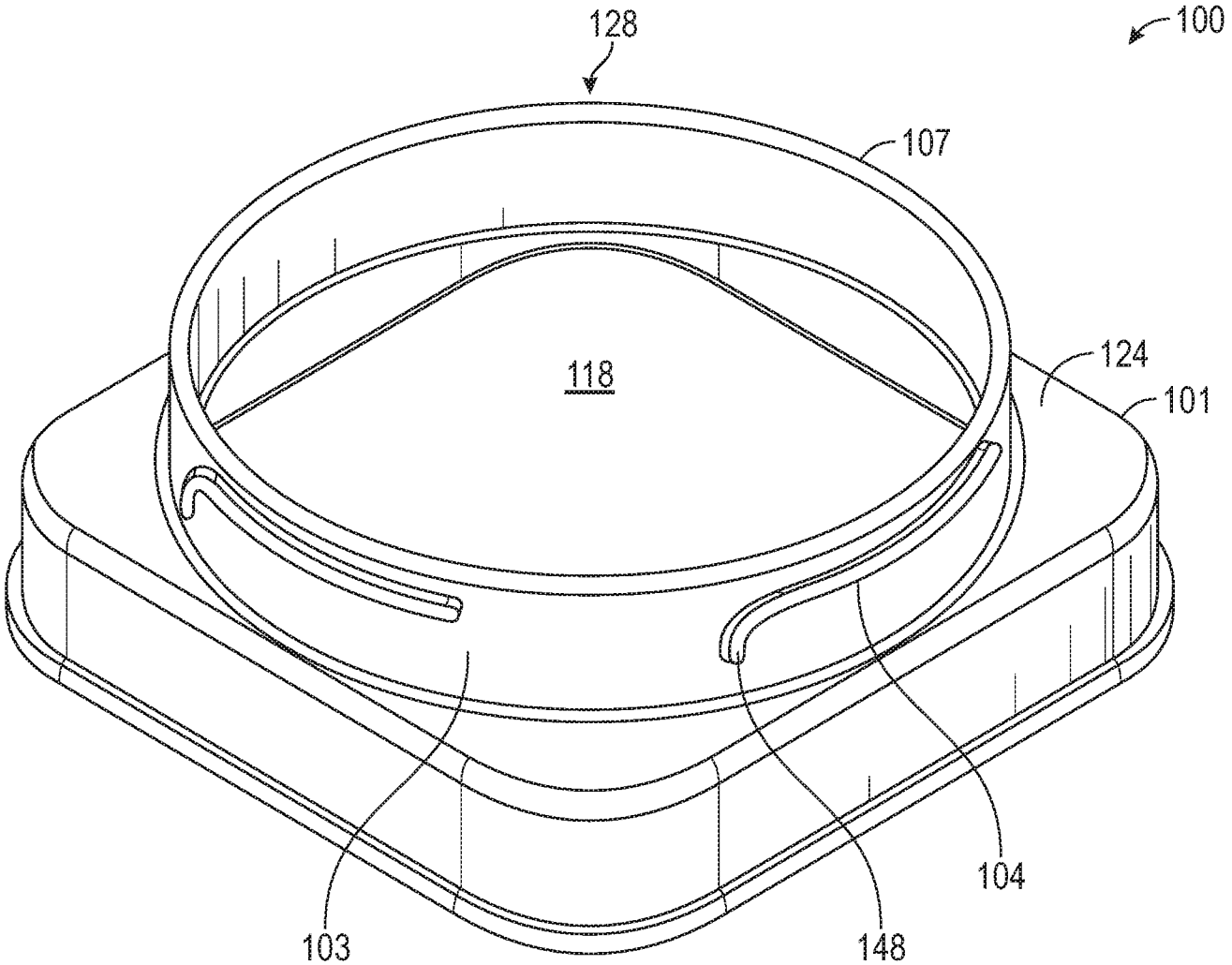
FIG. 10 is a perspective view of another of many embodiments of a child resistant container according to the disclosure.
Figure 11:
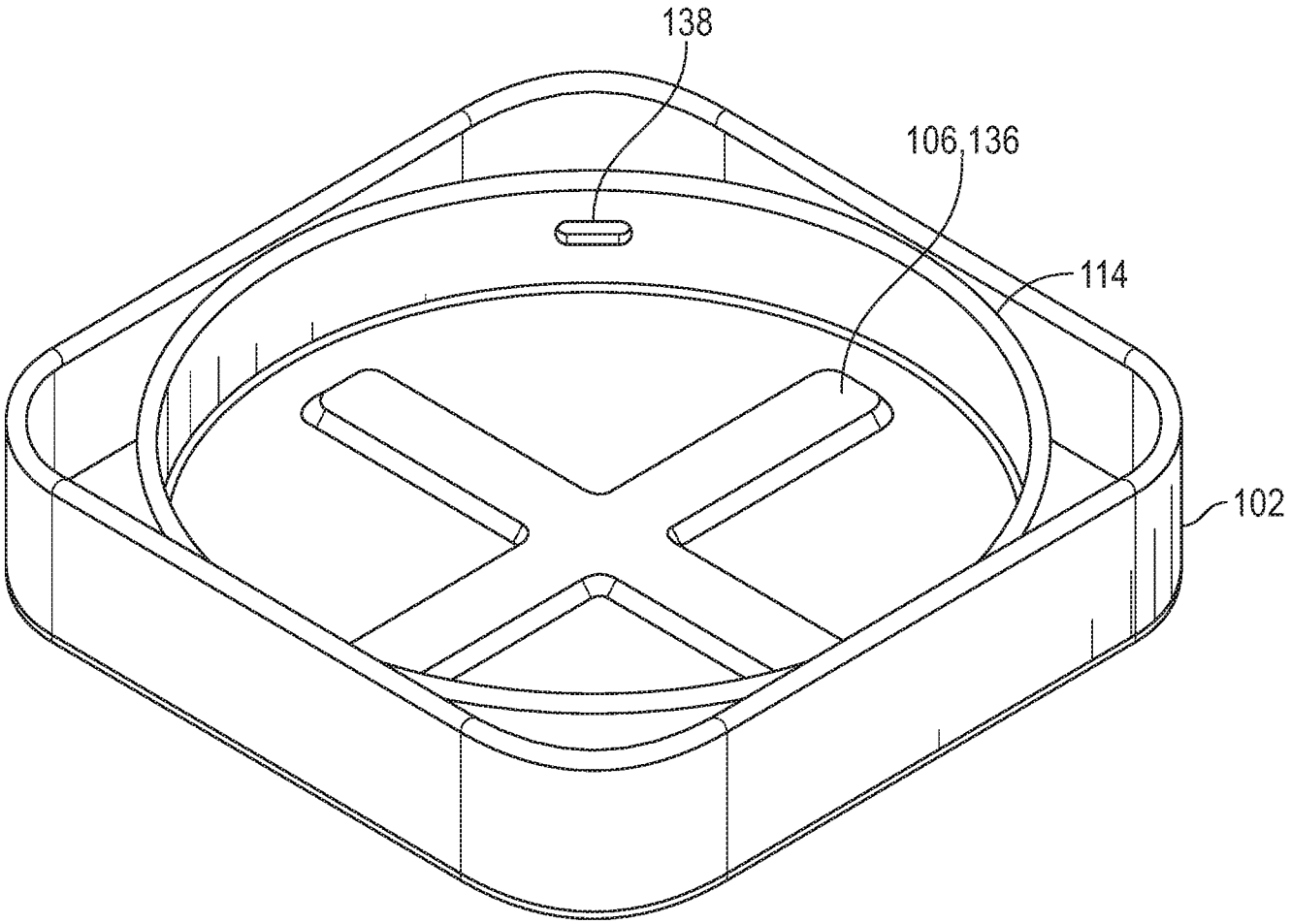
FIG. 11 is a bottom perspective view of another of many embodiments of a cap assembly according to the disclosure.

FIG. 1 is a perspective view of one of many embodiments of a child resistant container according to the disclosure. FIG. 2A is a side view of the container of FIG. 1 with the lid removed. FIG. 2B is a perspective view of the container of FIG. 1 with the lid removed. FIG. 3A is a top perspective view of one of many embodiments of an inner cap according to the disclosure. FIG. 3B is a cross-sectional side view of one of many embodiments of a cap assembly in an uncoupled position according to the disclosure. FIG. 3C is a cross-sectional side view of the cap assembly of FIG. 3B in a coupled position. FIG. 3D is a cross-sectional side view of one of many embodiments of a cap assembly coupled to a container body according to the disclosure. FIG. 3E is a detail view of a portion of FIG. 3D. FIG. 4 is a cross-sectional detail side of one of many embodiments of an indentation according to the disclosure. FIGS. 5A and 5B are top views of two of many embodiments of a center plate according to the disclosure. FIG. 6 is a cross-sectional perspective view of another of many embodiments of a cap assembly in an uncoupled position according to the disclosure. FIG. 7 is a perspective view of one of many embodiments of a child resistant container having a seal according to the disclosure. FIGS. 8A, 8B and 8C are bottom views of three of many embodiments of a seal having desiccant and/or oxygen scavenging material according to the disclosure. FIG. 9A is a perspective view of one of many embodiments of a child resistant container having a window according to the disclosure. FIG. 9B is a bottom view of the seal of FIG. 9A. FIG. 10 is a perspective view of another of many embodiments of a child resistant container according to the disclosure. FIG. 11 is a bottom perspective view of another of many embodiments of a cap assembly according to the disclosure. FIGS. 1-11 will be described in conjunction with one another. In at least one embodiment, a child resistant container 100 can include a container body 101, such as a housing or casing, for holding one or more products or substances and an outer cap 102, such as a cover or lid, for removably coupling to body 101 to enclose or cover at least a portion thereof, such as an interior 118 volume or space and/or one or more other components or portions of body 101 (e.g., neck 103 further described below). Outer cap 102 and the container body 101 can meet at a junction 120, such as a joint or intersection, which in at least one embodiment can be or include an at least partially seamless edge or other transition. For example, in at least one embodiment, body 101 and cap 102 can have the same outside diameter or other dimension, in whole or in part. Outer cap 102 can have a top 122 that is at least partially smooth or otherwise configured according to an implementation of the invention and can be configured to couple with body 101 in one or more of the manners further described below.

In at least one embodiment, container body 101 can have a neck 103, such as an extension or collar, for cooperating with one or more other components of container 100. Neck 103 can, but need not, have a diameter or other dimension less than that of another portion, such as a lower portion, of body 101. Neck 103 can be formed integrally with one or more other portions of body 101 or can be formed separately and otherwise coupled thereto. In at least one embodiment, container 100 can include a lip 124, such as a rim, stop, or collar, that extends radially inwardly from an exterior surface 126 of body 101. In such an embodiment, which is but one of many, outer cap 102 or one or more components coupled thereto can contact or rest on or against lip 124 (e.g., when cap 102 is in one or more closed positions), separately or in combination, in whole or in part. As other examples, outer cap 102 or one or more components coupled thereto can be disposed adjacent to, above, or otherwise relative to lip 124 when cap 102 is in one or more closed positions. In at least one embodiment, container body 101 or a portion thereof, such as a top portion or neck 103 (if present), can include an inwardly rolled edge 107 for cooperating with one or more other components of container 100 as described in further detail below. Edge 107 can be rolled or otherwise disposed radially inwardly (e.g., about central longitudinal axis X) from an exterior surface of body 101 or neck 103, in whole or in part, and can extend or otherwise exist about all or a portion of the mouth 128 or opening of body 101. Edge 107 can include a partial roll or a full roll and can be continuous or comprise one or more segments about mouth 128, separately or in combination, in whole or in part.

Container 100 can include an inner cap 105, such as a cover or lid, for removably coupling to body 101 to enclose or cover at least a portion thereof, such as an interior 118 volume or space and/or one or more other components or portions of body 101 (e.g., neck 103 or edge 107). Inner cap 105 can be coupled to outer cap 102, which can include being disposed at least partially therein, and configured to couple outer cap 102 and/or one or more other components of container 100 to container body 101. In at least one embodiment, inner cap 105 can have one or more dimensions (e.g., height and diameter or other radial dimension) smaller than one or more corresponding dimensions of outer cap 102 and inner cap 105 can be retained or otherwise disposed within outer cap 102 (see, e.g., FIGS. 3B-3C). For example, outer cap 102 can include an inwardly rolled or otherwise protruding edge 130 extending radially inwardly to form an inside dimension greater than an outside dimension of inner cap 105 and which can at least partially resist or prevent removal of inner cap 105 therefrom. In at least one embodiment, inner cap 105 can have an outwardly rolled or otherwise protruding edge 132 for cooperating with inwardly rolled edge 130 of outer cap 102 in one or more ways. For example, outwardly rolled edge 132 and inwardly rolled edge 130 can cooperate to retain at least a portion of inner cap 105 within at least a portion of outer cap 102. In at least one embodiment, at least a portion of inner cap 105 can "float" within at least a portion of outer cap 102 such that caps 102, 105 can move somewhat relative to one another in one or more directions. In at least one embodiment, one or more holes 146, such as an opening or other space (which can include a space created by, e.g., a contour or indentation), can be disposed in one or more locations on an interior surface or other portion of any of caps 102, 105 (and/or plates 110, further described below) for allowing lateral or other movement of one or more components relative to one or more other components of container 100. For example, as illustrated in FIGS. 3D-3E, a center or locking plate (or middle lid) 110 can include one or more holes 146 therein or therethrough for allowing out cap 102 and/or plate 110 and inner cap 105 to at least partially move in one or more lateral directions relative to one another, which can, for example, at least partially minimize a possibility of cross-threading or other binding of threads during installation or removal of cap assembly 114 to or from container body 101. As another example, outwardly rolled edge 132 and inwardly rolled edge 130 can be adapted for sliding engagement with one another when caps 102, 105 are in one or more positions relative to one another (further described below), such as for supporting rotation of one of caps 102, 105 relative to the other. One or both of edges 130, 132 can be rolled or otherwise disposed radially inwardly or outwardly (e.g., about central longitudinal axis X) from a surface of their respective caps, in whole or in part, and can extend or otherwise exist about all or a portion of such caps. One or both of edges 130, 132 can include a partial roll or a full roll and can be continuous or comprise one or more segments about their respective caps, separately or in combination, in whole or in part. As another example, at least a portion of one or more of edges 130, 132 can be formed by crimping, pressing, bending, or folding a portion of cap material to form such edge(s) or rim(s) (see, e.g., FIGS. 3B-3C), separately or in combination with one another and/or with rolling of the material, in whole or in part.

Inner cap 105 and outer cap 102 (which can collectively form or be part of a cap assembly 114 (together with one or more other cap components, such as plate 110, if present)) can be configured for optionally coupling with one another in one or more positions to optionally translate opening and/or closing force from one to the other. More specifically, inner cap 105 and outer cap 102 can have one or more positions relative to one another (e.g., in an axial direction along axis X) and can cooperate with one another and/or one or more other components of container 100 to form a child resistant opening/closing mechanism or otherwise accomplish child resistant functionality. In this regard, each of outer cap 102 and inner cap 105 can include one or more couplers 134, 136 for optionally coupling with one another to engage outer cap 102 and inner cap 105 for at least partially simultaneous rotation (e.g., about axis X) relative to one or more other components of container 100, such as container body 101. In at least one embodiment, couplers 134, 136 can be or include one or more mating indentations, indentions, depressions or other formations as further described below. In at least one embodiment, one or more of caps 102, 105 can include gripping material (not shown), such as silicone, rubber or another elastomeric or sticky material, coupled thereto for increasing friction between or otherwise supporting rotational engagement of caps 102, 105 in one or more positions. For example, gripping material can be included on one or more of the underside of cap 102 (or, e.g., plate 110 further described below) and the top side of cap 105, separately or in combination with the presence of one or more other couplers 134, 136 and, in at least one embodiment, can be included on one or more couplers 134, 136.

For example, as seen in FIGS. 3B-3C, in at least one embodiment, outer cap 102 can have one or more couplers 134 and inner cap 105 can have one or more couplers 136 and outer and inner caps 102, 105 can have one or more optional positions relative to one another for engagement and/or disengagement of one or more couplers 134, 136. As shown in FIG. 3B, for instance, outer and inner caps 102, 105 can have one or more uncoupled positions wherein couplers 134, 136 are uncoupled and axially separated from one another by a distance d along axis X, which can be any distance according to an implementation of the disclosure. In such a position (or another uncoupled position), outer and inner caps 102, 105 can relatively freely rotate relative to one another (i.e., subject to outside forces such as friction or gravity) and, for example, outer cap 102 can be rotated about inner cap 105 without causing rotation of inner cap 105. As shown in FIG. 3C, for instance, outer and inner caps 102, 105 can have one or more coupled positions wherein couplers 134, 136 are coupled and in which the axial separation is less than that of an uncoupled position (in whole or in part, and which can include zero). In such a position (or another coupled position), outer and inner caps 102, 105 can be at least partially rotationally fixed relative to one another so as to rotate together about, e.g., container body 101. One or more couplers 134 can engage one or more couplers 136 and, for example, can translate rotational force or motion from outer cap 102 to inner cap 105 or vice versa such that rotation of one causes at least some rotation of the other. In at least one embodiment, one or more axial forces or pressures and/or one or more rotational forces (as schematically illustrated by the various arrows in FIG. 3C) can be applied to one or more of outer cap 102 and inner cap 105, or one or more components coupled thereto (e.g., container body 101), to moves caps 102, 105 from an uncoupled position to a coupled position, which can, but need not, include elastic (or plastic) deformation of at least a portion of one or more of caps 102, 105. During a transition from an uncoupled to a coupled position, outer cap 102 can, but need not, at least partially rotate relative to inner cap 105, e.g., depending on the relative positions or alignment of caps 102, 105 and/or couplers 134, 136 upon the transition. In at least one embodiment, one or more of caps 102, 105 can be adapted for biasing caps 102, 105 and/or couplers 134, 136 toward an uncoupled position, such as by way of being shaped or otherwise configured for functioning similarly to a spring such that one or more of caps 102, 105 and/or couplers 134, 136 is forced or otherwise biased away from the other in a default position. The respective rolled edges 130, 132 of caps 102, 105 can, but need not, be in contact with one another in one or more coupled or uncoupled positions. For example, while rolled edges 130, 132 are shown to be axially separated in the embodiment of FIG. 3C for illustrative purposes, this need not be the case and alternatively, or collectively, rolled edges 130, 132 can be in contact with one another in one or more coupled positions of caps 102, 105 and/or couplers 134, 136 and, e.g., the top of outer cap 102 can be configured to elastically deform or otherwise move sufficiently during actuation to couple one or more couplers 134, 136 rolled edges 130, 132 are in contact with one another, whether in whole or in part.

As shown in the exemplary embodiment of FIGS. 1-3A, which is but one of many, container 100 can include one or more threads 104 for coupling engagement with one or more mating threads 138 of inner cap 105 for coupling and uncoupling outer cap 102, inner cap 105 (and/or one or more other container components) and container body 101. In at least one embodiment, container 100 can include one or more threads 104, 138 adapted for opening or closing container 100, or coupling or uncoupling one or more caps 102 (105, etc.) with or from body 101, in one quarter turn (see, e.g., FIGS. 10-11), one half turn, three-quarters turn, one full turn, two full turns, or less or more. In at least one embodiment, container 100 and thread(s) 104, 138 can be adapted for coupling and/or uncoupling outer cap 102 and container body 101 in no greater than two full turns, which can at least partially minimize or prevent slipping or cross-threading when a user applies pressure to the outer cap 102 and container body 101. Threads 104, 138 can be configured accordingly and, in at least one embodiment, can include stops or lands 148 formed therein or otherwise on container 100 to stop closing rotation of cap assembly 114 or a component thereof, such as upon reaching a fully closed position, and/or for at least partially resisting opening rotation, such as to guard against accidental or unintended opening of container 100. Due to the nature of the child resistant locking mechanisms of the present disclosure, there can in at least one embodiment be limits to how much force can or should be applied to unscrew inner cap 105 and/or outer cap 102 from container body 101 (or vice versa), such as to avoid the product becoming jammed. To this end, in at least one embodiment, threads 104, 138 can be limited to a single thread or, for instance, a set of threads configured to accomplish full closure of container 100 in less than or equal to one turn or two turns or so (e.g., of inner cap 105 and/or outer cap 102 relative to container body 101 or neck 103).

Couplers 134, 136 can take various forms, separately or in combination, in whole or in part. In at least one embodiment, one or more couplers 134, 136 can be or include one or more indentations stamped, molded, debossed or otherwise formed in or on cap 102 or cap 105, such as, for example, into one or more sheets or other piece(s) of material from which all or a portion of cap 102 or cap 105 may be made. Accordingly, couplers 134, 136 may be referred to herein as indentations (and collectively as indentations 106) for purposes of convenience or illustration, but it will nonetheless be understood that such references can apply to couplers 134, 136 of numerous other types or forms, such as couplers machined into material or couplers formed separately and coupled to one or more other pieces of material mechanically or otherwise.

Each of outer cap 102 and inner cap 105 can have one or more indentations 106 on one or more of its surfaces, such as in a top surface and/or protruding or otherwise extending downwardly from a bottom or interior surface. One or more of the indentations 106 can match one or more indentations 106 present on the other cap and can be disposed at a point or points where force(s) or pressure from a user is converted into friction or other actuation force(s) for allowing container 100 to be opened or closed. The number, shape, size, location and pattern of one or more indentations 106 can vary from embodiment to embodiment. The preferred embodiment depicted in FIGS. 1-3, which is but one of many, shows a cross-like formation comprising four generally rectangularly shaped indentations 106 that extend radially outwardly from axis X but which do not intersect. As another example, FIG. 5A shows a similar cross-like pattern comprising a single or continuous indentation 106 that includes four (or two) intersecting rectangular or prism sections forming a cross type shape. However, these are but two of many examples presented for purposes of illustration and explanation and are by no means limitative of the numerous potential embodiments of the present disclosure. Outer cap 102 and/or inner cap 105 can include any number and configuration of indentations 106 that accomplish the functions of embodiments of the disclosure, and can preferably include one or more indentations 106 comprising at least one working surface in each of the clockwise (CW) and counterclockwise (CCW) directions for providing a coupler edge or side that can cooperate with one another during opening and closing coupling engagement of caps 102, 105 (which can occur in the CCW and CW directions, respectively, or vice versa). For instance, in at least one embodiment, one or more of outer cap 102 and inner cap 105 can include four rectangular or otherwise shaped indentations 106, a single cross or similarly shaped indentation 111, a single linear indentation, one or more curved indentations, or multiple indentations, of, e.g., two, three, four, five, six, seven, eight, or more equally, or unequally spaced indentations. Outer cap 102 and inner cap 105 can have the same number of indentations 106 or a different number of indentations 106. Further, the size and/or shape of one or more indentations 106 of inner cap 105 can be the same as or different from the size and/or shape of one or more indentations 106 of outer cap 102, separately or in combination, in whole or in part. For example, in at least one embodiment, inner cap 105 can have a greater number of indentations 106 than outer cap 102, or vice versa. As another example, each of one or more indentations 106 on one of caps 102, 105 can be configured to couple with one, some, or all of one or more indentations 106 on the other of caps 102, 105. For instance, in at least one embodiment, outer cap 102 can have an indentation 106 configured to couple with any of two or more indentations 106 of inner cap 105 and such indentations can be of the same or different shapes and/or sizes. Alternatively, or collectively, outer cap 102 can have an indentation 106 configured to couple with only a particular one(s) of one or more indentations 106 of inner cap 105, which indentations can, once again, be of the same or different shapes and/or sizes. In at least some implementations of the disclosure, a relatively greater number of indentations 106 can be used for larger containers and less indentations 106 can be used for smaller containers. However, this need not be the case and the number of indentations used for a particular implementation of the disclosure can depend on one or more factors such as container size, shape, material, cost, aesthetics, contents, functionality and quality requirements, among other things, such as indentation size and shape. In at least one embodiment, a container having a diameter less than or equal to 70 mm can have four or less indentations 106 and can be made from material having a thickness of between 4.5 mm and 6 mm or so, which can at least partially minimize or prevent ripping or tearing of the material during manufacturing.

With continuing reference to the figures and particular reference to FIG. 4, one or more exemplary working surfaces of an indentation 106 is shown and described in more detail. One or more indentations 106 on outer cap 102 and/or inner cap 105 can include one or more open edges 108 for opening container 100 and one or more working edges 109 for closing container 100. One or more open edges 108 on outer cap 102 can engage one or more open edges 108 on inner cap 105, such as when caps 102, 105 are in a coupled position, for opening container 100. One or more working edges 109 on outer cap 102 can engage one or more working edges 109 on inner cap 105, such as when caps 102, 105 are in a coupled position, for closing container 100. Open edge 108 can be disposed at an angle A relative to horizontal and working edge 109 can be disposed at an angle B relative to horizontal. Angles A and B can be the same or different, whether for a given indentation 106 or two or more different indentations 106. In at least one embodiment, two or more different angles can be used on one or more edges. In at least one embodiment, angle B is preferably adapted to at least partially minimize or prevent overtightening, which can potentially make container 100 difficult to open. For example, angle B can be steep enough for transmitting closing force from outer cap 102 to inner cap 105 but shallow enough for facilitating at least partial disengagement or skipping of caps 102, 105 or two or more indentations 106 relative to one another upon reaching a fully closed position of inner cap 105, which can be or include any position about container body 101 according to an implementation of the disclosure. In at least one embodiment, angle A of open edge 108 can be steeper than angle B of working wedge 109, but that need not be the case. In at least one embodiment, one or more indentations 106 can have a working edge angle B of 75 degrees or in the range of 70 to 80 degrees or about 70 to 80 degrees. The angle can allow the mechanism to disengage when sealed tight, but that need not be the case. In at least one embodiment, one or more indentations 106 can have an open edge angle A of 60 degrees or in the range of 40 to 60 degrees or about 40 to 60 degrees. In at least one embodiment, such an angle A can decrease or minimize the amount of twist force to be exerted compensating for the closing motion while still requiring a push-down and twist motion to open the container. The range of 40 to 60 degrees from the horizontal may be used for the open edge. In at least one embodiment, such an angle A can cause container 100 to operate with enough difficulty to achieve child resistant requirements but not so difficult that adults are unable to reliably open the device. In at least one embodiment, one or more indentations 106 can have a working edge angle B of 60 degrees or in the range of 50 to 70 degrees or about 50 to 70 degrees. The angle can allow the mechanism to disengage when closed, but that need not be the case. In at least one embodiment, one or more indentations 106 can have an open edge angle A of 65 degrees or in the range of 55 to 75 degrees or about 55 to 75 degrees. In at least one embodiment, such an angle A can decrease or minimize the amount of twist force to be exerted compensating for the closing motion while still requiring a push-down and twist motion to open the container. In at least one embodiment, such as one or more of those mentioned above, working angle B can be adapted to allow for skipping of outer lid 102 relative to inner lid 105 upon reaching a closed position, which can mechanically and/or audibly signal a user that container 100 is in a fully closed or other state.

With continuing reference to the figures and particular reference to FIGS. 5A-6 (see also FIGS. 3B-3C), one or more exemplary embodiments of a container 100 having a center plate 110 is shown and described in more detail. As discussed above with reference to, e.g., FIGS. 1-3A, container 100 can include inner and outer lids 105, 102 each having one or more couplers or indentations 106 thereon for cooperating with one another in one or more manners according to the disclosure. However, in at least one embodiment, it can be desired to form one or more indentations 106 of outer cap 102 by stamping or pressing or another integral manner while nonetheless maintaining the top 122 or outer surface of outer cap 102 in a smooth or other condition that differs from or does not include such indentation(s) 106 (see, e.g., FIG. 1), whether for aesthetic purposes or otherwise. In such an embodiment, or in other embodiments, container 100 can include one or more plates 110, such as a disk, cap (e.g., middle cap) or other structure, having such indentation(s) 106 and coupled to outer cap 102 and disposed at least partially between outer cap 102 and inner cap 105. Plate 110 can be flat, curved, cylindrical, annular, or otherwise shaped for functioning according to the disclosure, separately or in combination, in whole or in part. Plate 110 can be rotationally fixed relative to outer cap 102 so as to function in at least substantially the same way as described elsewhere herein with regard to an embodiment of outer cap 102 having one or more indentations 106 formed directly thereon or otherwise coupled directly thereto. In at least one embodiment, plate 110 can be or include a third cap, such as a middle cap, disposed at least partially between outer cap 102 and inner cap 105 (see, e.g., FIGS. 3B-3C). Plate 110 can be coupled to inner cap 105 and/or outer cap 102 in any manner according to an implementation of the disclosure, which can, but need not, include having a rim or other portion rolled, crimped or otherwise formed simultaneously with one or more of rolled edges 130, 132 on caps 102, 105 (see, e.g., FIGS. 3B-3C). In at least one embodiment, one or more center plates 110 can be attached to the inside of outer cap 102 and/or placed between caps 102, 105 and can be configured such that a user must press or otherwise bias container body 101 and/or outer cap 102/plate 110 together or toward one another while or prior to applying horizontal rotational force for coupling and/or uncoupling the caps from body 101 to close or open container 100.

FIG. 5A depicts one of many embodiments of a center plate 110, which can be located at least partially between inner cap 105 and outer cap 102. Center plate 110 can be attached to inner cap 105 and/or outer cap 102 in any manner according to an implementation of the disclosure, including, but not limited to, mechanically, using one or more fasteners and/or by way of adhesive or other bonding measure(s). In at least one embodiment, center plate 110 can be disposed in between outer cap 102 and inner cap 105 without adhesive or another bonding agent and can be at least rotationally fixed relative to outer cap 102 mechanically, such as by way of rolling, stamping, bending, or otherwise manipulating at least a portion of each of plate 110 and cap 102 to connect the two components to one another and/or resist independent rotation. For example, in at least one embodiment, a cap 102 and plate 110 can include an at least partially collectively rolled or otherwise formed edge 144 (see, e.g., FIGS. 3B-3C), which can, but need not, include one or more crimps, dents, notches, or other couplers (e.g., in a radially inward or outward direction) for further supporting rotational fixation between cap 102 and plate 110. Center plate 110 can have one or more indentations 111 that at least partially match and fit into one or more indentations 106 on inner cap 105. When pressed together by a user, the indentations 111, 106 of center plate 110 and inner cap 105 can couple with one another and allow the locking plate 110, inner cap 105, and outer cap 102 to be unscrewed and/or separated from container body 101 or, conversely, screwed onto container body 101. The indentations 111 illustrated in FIGS. 5A-6 are but some embodiments of many according to the disclosure. Indentations 111 can include one or more working edges 112 and open edges 113 on opposite sides of one or more indentations 111 or one or more portions thereof that can couple with indentations 106 on inner cap 105 for closing and opening the lid assembly accordingly. In at least one embodiment, one or more center locking plates 110 can be used, for example, where indentations 106, 111 are not manufactured into or directly coupled to outer cap 102. In at least one embodiment, an outer cap 102 with a smooth or otherwise configured top surface 122 can be desired and plate 110 having one or more indentations 111 can be affixed to the inside of outer cap 102 in lieu of (or collectively with) one or more indentations on outer cap 102. Outer cap 102 can be used to press plate 100 downwardly or otherwise toward inner cap 105 to engage one or more indentations 106, 111 and allow inner cap 105 and outer cap 102 (and plate 110) to turn as one. As illustrated in FIGS. 5A-6 for exemplary purposes, one or more indentations 111 can, but need not, extend to or otherwise be disposed at the center of plate 110 and/or all the way to the radial exterior or termination of plate 110.

As shown in FIG. 6, outer cap 102 can be disposed at least partially over inner cap 105 and locking plate 110 and can be configured to couple with container body 101, such as by coupling with neck 103 and/or lip 124, which can but need not include forming a seamless edge 120. Outer cap 102 can have an inwardly rolled or otherwise formed edge 130 on its open end and can include a channel 140 for holding at least a portion of inner cap 105 and/or plate 110 (if present). Inner cap 105 can fit in the channel and at least a portion can be retained such that it cannot exit channel 140 but nonetheless can at least partially float and rotate inside channel 140. In at least one embodiment, the fit of outer cap 102 on inner cap 105 can be loose enough that turning outer cap 102 will not turn inner cap 105 against the resistance of container body 101 or threads 104. When outer cap 102 is pushed down by a user, it and/or locking plate 110 (if present) can lock with inner cap 105 via indentations 106, 111 for separating the entire cap assembly or unit from container body 101 and/or coupling it thereto.

In at least one embodiment, outer cap 102 can be stamped or otherwise outfitted with one or more indentations 106, 111 instead of (or alongside) using one or more center plates 110. In such an embodiment, one or more indentations 106, 111 can be manufactured into outer cap 102 and can interact directly (or indirectly) with one or more indentations on inner cap 105 (and/or plate 110, if present). The same open and working angles can, but need not, be used in the case where outer cap 102 does not have indentations therein or thereon. In at least one embodiment, such as an embodiment wherein outer cap 102 does not require a smooth superior exterior surface plane, center plate 110 can be absent and one or more indentations 106, 111 can be embossed or otherwise manufactured into the superior exterior surface plane of outer cap 102 for matching or coupling with one or more indentations 106, 111 of inner cap 105. Accordingly, embodiments of the disclosure can have lid or cap assemblies (or units) comprising a number of cap components coupled to one another, such as a two-piece lid or a three-piece lid (e.g., with a locking plate included); however, embodiments having more or less components are also possible.

In at least one embodiment, container 100 can include one or more seals 115, such as a lidding film, sealing film, or other closure for creating an at least partially air tight seal, whether initially, repeatedly or otherwise (see, e.g., FIG. 7). One or more seals 115 can be coupled to any of container body 101, outer lid 102, inner lid 105 and plate 110, separately or in combination, in whole or in part. In at least one embodiment, seal 115 can be used over the opening of container body 101 and can, for example, be applied during packaging of a product. In at least one embodiment, seal 115 can at least partially prevent the escape of an inert gas or other fluid within container 100, such as, for example, a gas or other fluid for supporting prolonged, safe, fresh or otherwise desirable storage of one or more products stored in container 100. In at least one embodiment, one or more seals 115 can be coupled to inwardly rolled edge 107 on neck 103 and/or another portion of neck 103, such as on its radial exterior surface. In at least one embodiment, edge 107 can form or include a coupling surface sufficient to support coupling of seal 115 to container body 101, temporarily, permanently, or otherwise. For example, in at least one embodiment, edge 107 can be or include one or more flat or curved surfaces at least 2 mm thick (e.g., in the radial direction about axis X) for a lidding film or induction film to bond; however, numerous other configurations are possible.

In at least one embodiment, seal 115 can be or include a multi-layered seal, such as a multi-layer aluminum foil seal or other type of seal having a plurality of layers (which can be of the same or different material(s)). Seal 115 can be disposed at least partially over the opening of container body 101 and can be attached to inwardly rolled edge 107. In at least one embodiment, seal 115 can be or include one or more annular silicone or otherwise elastomeric seals, such as a gasket, coupled to one or more of caps 102, 105 (or plate 110, if present). Seal 115 can be sealed or otherwise coupled to container body 101 in any manner according to an implementation of the disclosure, such as by way of a heat activated adhesive coating, induction sealing, conduction sealing, or otherwise. In at least one embodiment, seal 115 can be or include one or more desiccant materials and/or oxygen scavenge materials 116. For instance, one or more materials 116 can be applied or otherwise coupled to one or more sides of seal 115, such as a product facing side 142 of seal 115 disposed at least partially within or toward the bottom interior of container body 101 or a product disposed within container body 101 (e.g., when seal 115 is at least partially coupled to edge 107). In at least one embodiment, seal 115 can be or include a tamper evident seal, which can be used alone or, for example, in addition to one or more tamper evident seals or packaging on the outside of container 100. In at least one embodiment, seal 115 can be configured to provide an at least partial barrier to light, oxygen, air water, odors and/or one or more other environmental or other conditions in an atmosphere surrounding container 100. In at least one embodiment, seal 115 can be contact conduction sealed to inward rolled edge 107 of container body 101 of a metal child-resistant container 100. One or more seals 115 can be either flat or recessed, separately or in combination, in whole or in part. In at least one embodiment, one or more seals 115 can have at least one of a protective lacquer layer, an aluminum foil layer, an extrusion coating layer (e.g., with a heat activated adhesive), and a combination thereof.

In at least one embodiment, desiccant material and/or oxygen scavenge material 116 can be or include at least one of activated alumina, aerogel, benzophenone, bentonite clay, calcium chloride, calcium oxide, calcium sulfate (gypsum), cobalt(II) chloride, copper(II) sulfate, lithium chloride, lithium bromide, magnesium sulfate, magnesium perchlorate, molecular sieve, potassium carbonate, potassium hydroxide, silica gel, sodium, sodium chlorate, sodium chloride, sodium hydroxide, sodium sulfate, sucrose, or sulfuric acid, ferrous carbonate, metal halide catalyst, ascorbate, sodium hydrogen carbonate, citrus, ascorbic acid, and a combination thereof. The amount and material makeup of desiccant and/or oxygen scavenge material 116 can vary from embodiment to embodiment. In at least one embodiment, material 116 can be configured to maintain a relative humidity (RH) inside container 100 of between 50-65% or so. In at least one embodiment, desiccant and/or oxygen scavenging material 116 can be applied to a portion of seal 115 or otherwise configured for allowing a heat activated adhesive layer of seal 115 to still function properly, which can, for example, at least partially reduce as need for nitrogen flushing or separate desiccant packets in one or more of many possible implementations of the disclosure. In at least one embodiment, desiccant and/or oxygen scavenging material 116 can be coupled to one or more seals 115 by heat staking and/or adhesive, whether separately or in combination with one or more other couplers or coupling manners.

FIGS. 8A, 8B, and 8C depict some of many exemplary embodiments of a seal 115 having desiccant material and/or oxygen scavenging material 116 according to the disclosure for illustrative purposes. For example, in at least one embodiment, one or more seals 115 can be or include one or more desiccant and/or oxygen scavenging materials 116 in the form of one or more strips, stickers, patches, or other media, which can be of any size and/or shape according to an implementation of the disclosure, such as circular, annular, square, rectangular, or otherwise. Desiccant material and/or oxygen scavenging material 116 can be made as large or small as necessary (e.g., by weight, volume, area, or another measure) to create a desired RH or other atmosphere inside an embodiment of container 100, which can be or include any atmosphere according to an implementation of the disclosure. One or more strips, patches or other holders of desiccant material and/or oxygen scavenging material 116 can be attached to the inside or product facing side 142 of seal 115 (and/or elsewhere, such as anywhere inside container 100). Strips, patches or other holders of desiccant material and/or oxygen scavenging material 116 can be modular so as to allow for different amounts of desiccant material and/or oxygen scavenging material 116 to be used among one or more embodiments for creating a desired atmosphere inside container 100 by adding and/or subtracting incremental units of desiccant material and/or oxygen scavenging material 116.

FIGS. 9A and 9B depict one of many embodiments of a container 100 according to the disclosure having a window 117. In at least one embodiment, container 100 can include one or more windows 117, such as a closed or optionally openable space or portal, for enabling a user to view the contents of container 100 while at least having the option of doing so without at least partially removing seal 115 from container 100. In at least one embodiment, window 117 can be or include one or more holes or other openings in or through seal 115 and covered by an at least partially clear or translucent film. A window can allow a product stored and sealed in container 100 to be viewed without a seal 115 being broken, which can include allowing a customer or other user to view a product and know the seal and/or product have not been tampered with. In at least one embodiment, viewing window 117 can include a hole in a foil or other seal 115 sealed with a film bonded to seal 115, such as to an interior or exterior surface thereof. Such a film(s) of the viewing window 117 can be attached to seal 115 through any of various bonding or other coupling techniques and can be attached to seal 115 on product facing side 142, on an opposite or other side facing inner cap 105 (if present), or both. In at least one embodiment, window 117 can be centered or otherwise disposed on or in seal 115 and one or more desiccant and/or oxygen scavenging materials 116 can be disposed in an annular or doughnut shape surrounding or otherwise disposed relative to window 117. In at least one embodiment, at least a portion of window 117, such as a clear film or other material(s), can be sandwiched between desiccant and/or oxygen scavenging material 116 and seal 115, such as at the edges of window 117 or, as another example, between one or more layers of seal 115. In at least one embodiment, window 117 can be offset to one or more sides of seal 115 and desiccant and/or oxygen scavenging material 116 can be located on a portion of seal 115 such that at least a portion of desiccant and/or oxygen scavenging material 116 is not viewable through window 117. In at least one embodiment, desiccant material and/or oxygen scavenging material 116 can be in one or more separate locations on product facing side 142 of seal 115 that do not overlap window 117.

In at least one embodiment, a container body can be cup-shaped with a recessed neck at the top portion where it will meet the outer cap and can have a threaded portion extending upwardly for contacting and removably coupling with one or more caps, such as inner cap, outer cap, and/or one or more other caps, plates or other components (if present). In at least one embodiment, a container body can be at least partially bowl-shaped (i.e., having a mouth larger than a base), which can make for more efficient packaging, shipping and/or storage by way of nestability of containers 100 or one or more components thereof, such as container bodies 101 and/or caps or cap assemblies. In at least one embodiment, one or more caps according to the disclosure can be configured to couple with a container body comprising a base or bottom cap coupled to a spiral wound tube or spiral wound tubing, such as tubing comprised in whole or in part of metal, paper, cardboard, chip board and/or one or more other materials (e.g., plastic). The base or bottom cap can be of the same or a different material(s). In at least one embodiment, a spiral wound container body 101 can include a top cap, such as an open top cap, having threading thereon for coupling with one or more caps according to the disclosure (e.g., in place of neck 103). In at least one embodiment, any one or more of outer cap 102, inner cap 105, plate 110, body 101, or combination thereof can include one or more windows for allowing product stored inside container 100 to be viewed without opening the container. In at least one embodiment, container 100 can be hermetically sealed, which can include one or more multi-piece lid assemblies of the present disclosure coupled to a hermetically sealed container body 101. In at least one embodiment, container 100 can be at least partially resealable, such as by having one or more reusable seals or sealing mechanisms.

In at least one embodiment, container 100 can have a height between 25 mm and 200 mm (inclusive) and a diameter of between 60 mm and 120 mm (inclusive) in a closed configuration, such as but not limited to a fully closed position. In at least one embodiment, container 100 or a portion thereof (e.g., body 101 or cap 102) can have a diameter of 68 mm and a height of the body before the inward rolled edge can be 30.72 mm. The threaded neck 103 can be smaller (but need not) and can have, for example, a diameter of 61.67 mm. The shape and size of an inwardly rolled edge can vary based on, e.g., the diameter or other size of a container 100. In at least one embodiment, one or more ends, edges, lips, or other portions can be rolled at least 25%, or more or less. In at least one embodiment, one or more lids 102, 105 and/or plates 110 can be rolled or otherwise formed or deformed together or simultaneously. One or more holes or openings or other spaces can be disposed in one or more locations on an interior surface or other portion of any of lids 102, 105 and/or plates 110 for allowing lateral or other movement of one or more components relative to one or more other components of container 100, which can include one another. In at least one embodiment, one or more couplers 134, 136 or indentations 106, 111 can have a depth of 0.85 mm and a width of 5.27 mm and a length of 16.62 mm. In at least one embodiment, a diameter or other major dimension of a center plate 110 can be 66 mm. In at least one embodiment, plate 110 and/or one or more caps 102, 105 can include one or more indentations extending from the center outward in a cross or other pattern and one or more of the indentations can be 4.79 mm in width and 15.82 mm in length. The indentations can vary in size, number and shape from embodiment to embodiment and the size, number and/or shape of the indentations can vary depending on, e.g., the number of indentations or the size of the container. In at least one embodiment, container body 101 and/or one or more other components of container 100 can be comprised at least partially of aluminum; however, other metals can be used as well, including steel, tin, copper, and alloys of any of the foregoing materials, separately or in combination, in whole or in part. Other exemplary materials include plated metals, such as tin plated steel and copper plated steel. While the exemplary embodiments of some of the figures have round or circular exterior shapes, this need not be the case and other shapes of container 100 are possible. For instance, container 100 or a portion(s) thereof can be square (see, e.g., FIGS. 10-11), rectangular, triangular, or any other shape(s), separately or in combination, and one or more of neck 103, caps 102 (if present), cap 105 and plate 110 (if present) can be coupled thereto or disposed at least partially therein, for example in a "shell" cap 150 or container body 101. In such an embodiment, cap 150 can be or include outer cap 102 or, as another example, a lid assembly 114 can include an outer cap 102, middle plate 110 and inner cap 105 coupled to cap 150. Such dimensions, quantities, shapes, sizes, materials and other attributes or details can and likely will differ among embodiments and can include any dimensions, quantities, shapes, sizes, materials and other attributes or details according to an implementation of the disclosure.

In at least one embodiment, a child resistant container can include a container body having a central longitudinal axis, a closed base, an open top and an exterior wall, and a cap assembly configured to couple to the container body for closing the container. A cap assembly can include an inner cap configured to couple to a container body and an outer cap coupled to the inner cap, each of the inner and outer caps having a top, a first coupler coupled to the inner cap, and a second coupler coupled to the outer cap and configured to optionally engage the first coupler. An inner cap can be disposed at least partially within an outer cap. At least a portion of the top of an outer cap can be configured to optionally move among first and second or other positions relative to the inner cap, such as along the central longitudinal axis or otherwise. A first or other position can be farther away from a top of the inner cap than a second or other position. An outer cap can be configured to rotate relative to an inner cap, such as when the top of the outer cap is in one or more positions, and a second or other coupler can be configured to engage a first or other coupler, such as when a top of an outer cap is in a second or other position.

A child resistant container can include a container body having a closed base, an open top and an exterior wall, wherein the exterior wall can include a lower portion and an upper portion and wherein the upper portion can include a threaded neck that extends upwardly from a lip that extends radially inwardly from a lower portion of a wall, an inner cap, wherein the inner cap can include threads configured to couple with a threaded neck and one or more indentations that protrude downwardly from a top of the inner cap, and an outer cap coupled to the inner cap and configured to selectively engage the inner cap for rotation of the inner cap about a threaded neck, wherein the outer cap has a top disposed at least partially over a top of the inner cap and can include one or more indentations that protrude downwardly from a top of the outer cap, and wherein one or more indentations of the outer cap can be configured to engage one or more indentations of the inner cap when pressure is applied to a top of the outer cap in a direction toward a top of the inner cap.

A child resistant container can include a container body having a closed base, an open top and an exterior wall, wherein the exterior wall can include a lower portion and an upper portion and wherein the upper portion can include a threaded neck that extends upwardly from a lip that extends radially inwardly from the lower portion of the wall, an inner cap, wherein the inner cap can include threads configured to couple with the threaded neck and one or more indentations that protrude downwardly from a top of the inner cap, an outer cap coupled to the inner cap and configured to selectively engage the inner cap for rotation of the inner cap about the threaded neck, wherein the outer cap has a top disposed at least partially over the top of the inner cap, and a locking plate coupled to the outer cap and disposed at least partially between the top of the inner cap and the top of the outer cap, wherein the locking plate can include one or more indentations that protrude downwardly, and wherein the one or more indentations of the locking plate can be configured to engage the one or more indentations of the inner cap when pressure is applied to the top of the outer cap in a direction toward the top of the inner cap.

A child resistant container can include a container body having a closed base, an open top and an exterior wall, wherein the exterior wall can include a lower portion and an upper portion and wherein the upper portion can include a threaded neck that extends upwardly from a lip that extends radially inwardly from the lower portion of the wall, an inner cap, wherein the inner cap can include threads configured to couple with the threaded neck and one or more indentations that protrude downwardly from a top of the inner cap, an outer cap coupled to the inner cap and configured to selectively engage the inner cap for rotation of the inner cap about the threaded neck, wherein the outer cap has a top disposed at least partially over the top of the inner cap, and a locking plate coupled to the outer cap and disposed at least partially between the top of the inner cap and the top of the outer cap, wherein the locking plate can include one or more indentations that protrude downwardly, and wherein the one or more indentations of the locking plate can be configured to engage the one or more indentations of the inner cap when pressure is applied to the top of the outer cap in a direction toward the top of the inner cap, wherein the inner cap can be retained within the outer cap by an inwardly rolled edge of the outer cap, and wherein the inner cap can be configured to selectively rest on the inwardly rolled edge of the outer cap.

A container can include a plate disposed at least partially between the top of the inner cap and the top of the outer cap, and a second or other coupler can be coupled to the plate. One or more plates can be rotationally fixed relative to an outer cap or other component or portion of a container. A top of an outer cap can be in a second or other position and an outer cap can be adapted to rotate relative to an inner cap, such as before a second or other coupler engages a first or other coupler, which can include rotating a partial rotation such as less than 45 degrees or less than 90 degrees or less than 180 degrees or otherwise. At least a portion of a top or other portion of an outer cap can be configured to elastically deform and a first or other position relative to a top of an inner cap can be a rest position of the top or other portion of an outer cap. At least a portion of an inner cap can be retained within an outer cap, such as by a wholly or partially radially inwardly rolled or otherwise disposed lip of the outer cap. An inner cap can include a radially outwardly rolled or otherwise disposed lip and can have a height or other dimension less than, greater than or equal to a height or other dimension of an outer cap. A radially outwardly rolled lip of an inner cap can be configured to at least optionally contact a radially inwardly rolled lip of an outer cap.

A first or other coupler can include a groove and a second or other coupler can include a tongue configured to engage the groove. A first or other coupler can include a plurality of grooves and a second or other coupler can include a plurality of tongues configured to engage corresponding ones of the plurality of grooves. A number of grooves, tongues or other couplers can be the same or different. A first or other coupler can include a plurality of grooves and a second or other coupler can include a tongue adapted to engage two or more of the plurality of grooves. A first or other coupler can include a plurality of grooves that extend radially outwardly from a central longitudinal axis or other point or reference. Two or more of a plurality of grooves can intersect or not intersect. Two or more of a plurality of grooves can be at least partially perpendicular to one another. A first or other coupler can include a groove having a rotationally leading side and a rotationally trailing side in a clockwise or other direction and a second coupler can include a tongue having a rotationally leading side and a rotationally trailing side in a clockwise or other direction. A leading or other side of a tongue can be configured to engage a leading or other side of a groove, such as for coupling a cap assembly to a container body. A trailing or other side of a tongue can be configured to engage a trailing or other side of a groove, such as for uncoupling a cap assembly from a container body.

Leading or other sides of a tongue and/or a groove can be disposed at a first or other angle(s) and trailing sides of a tongue and/or a groove can be disposed at a second or other angle(s). In at least one embodiment, first and second angles, or other angles, can be the same. In at least one embodiment, first and second angles, or other angles, can be different. In at least one embodiment, a first angle can be 60 degrees relative to horizontal and a second angle can be 65 degrees relative to horizontal. A first or other coupler can include two or more grooves and a second or other coupler can be configured to skip out of one or more grooves and into one or more grooves, such as when the cap assembly reaches a fully closed position. One or more couplers can be adapted for at least partially minimizing a chance of overtightening. One or more couplers can be adapted for signaling or indicating to a user that a container is fully or otherwise closed, such as audibly or mechanically or both, which can include generating one or more sounds, vibrations, or other mechanical attributes or indicators, such as by way of skipping or another noticeable cooperation or result of cooperation among one or more container components.

In at least one embodiment, a child resistant container can include a container body having a central longitudinal axis, a closed base, an open top and an exterior wall, and a cap assembly configured to couple to the container body for closing the container. A cap assembly can include an inner cap configured to couple to the container body and an outer cap coupled to the inner cap, each of the inner and outer caps having a top, a first coupler coupled to the inner cap, wherein the first coupler can include a plurality of grooves that extend radially outwardly from the central longitudinal axis, and a second coupler coupled to the outer cap and configured to optionally engage the first coupler, wherein the second coupler can include a plurality of tongues, wherein the inner cap can be disposed at least partially within the outer cap and can include a radially outwardly rolled lip that can be retained within the outer cap by a radially inwardly rolled lip of the outer cap, wherein at least a portion of the top of the outer cap can be configured to optionally move among first and second positions relative to the inner cap along the central longitudinal axis, the first position being further away from the top of the inner cap than the second position, wherein the outer cap can be configured to rotate relative to the inner cap when the top of the outer cap is in the first position and the radially inwardly rolled lip of the outer cap is in contact with the radially outwardly rolled lip of the inner cap, and wherein the second coupler can be configured to engage the first coupler when the top of the outer cap is in the second position.

A child resistant container can include a container body having a closed base, an open top and an exterior wall, wherein the exterior wall can include a lower portion and an upper portion and wherein the upper portion can include a threaded neck that extends upwardly from a lip that extends radially inwardly from the lower portion of the wall, an inner cap, wherein the inner cap can include threads configured to couple with the threaded neck and one or more indentations that protrude downwardly from a top of the inner cap, an outer cap coupled to the inner cap and configured to selectively engage the inner cap for rotation of the inner cap about the threaded neck, and a seal configured to enclose the open top of the container body. An outer cap can have a top disposed at least partially over a top of an inner cap and can include one or more indentations that protrude downwardly from the top of the outer cap. One or more indentations of an outer cap can be configured to engage one or more indentations of an inner cap, such as when a force or pressure is applied to a top or other portion of the outer cap in a direction toward the top of the inner cap or otherwise. A threaded or other neck can include a radially inwardly rolled edge and one or more seals can be configured to couple to the radially inwardly rolled edge of the threaded neck. A child resistant container can include a container body having a closed base, an open top and an exterior wall, wherein the exterior wall can include a lower portion and an upper portion and wherein the upper portion can include a threaded neck that extends upwardly from a lip that extends radially inwardly from the lower portion of the wall, an inner cap, wherein the inner cap can include threads configured to couple with the threaded neck and one or more indentations that protrude downwardly from a top of the inner cap, an outer cap coupled to the inner cap and configured to selectively engage the inner cap for rotation of the inner cap about the threaded neck, and a seal configured to enclose the open top of the container body. An outer cap can have a top disposed at least partially over the top of the inner cap and can include one or more indentations that protrude downwardly from the top or another portion of the outer cap. One or more indentations of the outer cap can be configured to engage one or more indentations of the inner cap, such as when force or pressure is applied in one or more directions, such as to the top or other portion(s) of the outer cap in a direction toward the top or another portion of the inner cap. A container can include a container body having a closed base, an open top and an exterior wall, wherein the exterior wall can include a lower portion and an upper portion and wherein the upper portion can include a threaded neck that extends upwardly from a lip that extends radially inwardly from a lower portion of a wall, an inner cap, wherein the inner cap can include threads configured to couple with a threaded neck and one or more indentations that protrude downwardly from a top of the inner cap, and an outer cap coupled to the inner cap and configured to selectively engage the inner cap for rotation of the inner cap about a threaded neck, wherein the outer cap has a top disposed at least partially over a top of the inner cap and can include one or more indentations that protrude downwardly from a top of the outer cap, and wherein one or more indentations of the outer cap can be configured to engage one or more indentations of the inner cap when pressure is applied to a top of the outer cap in a direction toward a top of the inner cap.

Other and further embodiments utilizing one or more aspects of the systems and methods disclosed herein can be devised without departing from the spirit of Applicant's disclosure. For example, the systems and methods disclosed herein can be used alone or to form one or more parts of other containers, container components and/or container systems. The locking and/or child resistant mechanisms of the disclosure can be applied to various forms of containers. As another example, although the embodiments shown in the figures for illustrative purposes reflect one or more exemplary shapes of containers, caps, plates and indentations, this is in no way intended to be limiting or exhaustive as, in use, various embodiments and modifications can be implemented using different configurations, whether for various types of products or otherwise. Further, the various methods and embodiments of the containers and components can be included in combination with each other to produce variations of the disclosed methods and embodiments.

Discussion of singular elements can include plural elements and vice-versa. References to at least one item followed by a reference to the item can include one or more items. Also, various aspects of the embodiments can be used in conjunction with each other to accomplish the understood goals of the disclosure. Unless the context requires otherwise, the words "comprise," "include," and "has" (including variations and conjugations thereof, such as "comprises," "including," "have" and so forth) should be understood to imply the inclusion of at least the stated element or step or group of elements or steps or equivalents thereof, and not the exclusion of a greater numerical quantity or any other element or step or group of elements or steps or equivalents thereof. The devices, apparatuses and systems can be used in a number of directions and orientations. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components and/or can be combined into components having multiple functions.

The embodiments have been described in the context of preferred and other embodiments and not every embodiment of Applicant's disclosure has been described. Obvious modifications and alterations to the described embodiments are available to those of ordinary skill in the art having the benefits of the present disclosure. The disclosed and undisclosed embodiments are not intended to limit or restrict the scope or applicability of Applicant's disclosures, but rather, in conformity with the patent laws, Applicant intends to fully protect all such modifications and improvements that come within the scope or range of equivalents of the claims.

What is claimed is:

1. A child resistant container, comprising:

a container body having a central longitudinal axis, a closed base, an open top and an exterior wall; and a cap assembly configured to couple to the container body for closing the container;

wherein the cap assembly comprises a metal inner cap configured to couple to the container body and a metal outer cap coupled to the inner cap, each of the inner and outer caps having a top with a top surface and a bottom surface;

a metal plate disposed between the inner cap and the outer cap, wherein the plate is rotationally and axially fixed relative to the outer cap;

a first coupler coupled to the inner cap, wherein the first coupler comprises a groove having sides that extend downwardly from the top of the inner cap; and a second coupler coupled to the plate and configured to optionally engage the first coupler, wherein the second coupler comprises a tongue having sides that extend downwardly from a bottom surface of the metal plate;

wherein the inner cap is disposed at least partially within the outer cap;

wherein at least a portion of the top of the outer cap is configured to optionally move among first and second positions relative to the inner cap along the central longitudinal axis, the first position being farther away from the top of the inner cap than the second position;

wherein the outer cap is configured to rotate relative to the inner cap when the top of the outer cap is in the first position; and wherein the second coupler is configured to engage the first coupler when the top of the outer cap is in the second position for rotationally fixing the inner and outer caps relative to one another.

2. The container of claim 1, wherein at least a portion of the second coupler is disposed beneath the top surface of the top of the inner cap when the first and second couplers are fully engaged.

3. The container of claim 1, wherein, when the top of the outer cap is in the second position and the first and second couplers are not engaged, the outer cap is adapted to rotate relative to the inner cap before the second coupler engages the first coupler.

4. The container of claim 1, wherein at least a portion of the top of the outer cap is configured to elastically deform and the first position relative to the top of the inner cap is its rest position.

5. The container of claim 1, wherein at least a portion of the inner cap is retained within the outer cap by a radially inwardly rolled lip of the outer cap.

6. The container of claim 5, wherein the inner cap comprises a radially outwardly rolled lip and a height that is less than a height of the outer cap, and wherein the radially outwardly rolled lip of the inner cap is configured to at least optionally contact the radially inwardly rolled lip of the outer cap.

7. The container of claim 1, wherein the first coupler comprises a plurality of grooves and the second coupler comprises a plurality of tongues configured to engage corresponding ones of the plurality of grooves.

8. The container of claim 1, wherein the first coupler comprises a plurality of grooves and the tongue is adapted to engage two or more of the plurality of grooves.

9. The container of claim 1, wherein the first coupler comprises a plurality of grooves that extend radially outwardly from the central longitudinal axis.

10. The container of claim 9, wherein two or more of the plurality of grooves intersect.

11. The container of claim 9, wherein two or more of the plurality of grooves are at least partially perpendicular to one another.

12. The container of claim 1, wherein the groove has a rotationally leading side and a rotationally trailing side in a clockwise direction and the tongue has a rotationally leading side and a rotationally trailing side in a clockwise direction;

wherein the leading side of the tongue is configured to engage the leading side of the groove for coupling the cap assembly to the container body; and wherein the trailing side of the tongue is configured to engage the trailing side of the groove for uncoupling the cap assembly from the container body.

13. The container of claim 12, wherein the leading sides of the tongue and groove are disposed at a first angle and the trailing sides of the tongue and groove are disposed at a second angle.

14. The container of claim 13, wherein the first and second angles are the same.

15. The container of claim 13, wherein the first and second angles are different.

16. The container of claim 13, wherein the first angle is 60 degrees relative to horizontal and the second angle is 65 degrees relative to horizontal.

17. The container of claim 13, wherein the groove is a first groove, wherein the first coupler further comprises a second groove, and wherein the tongue is configured to skip out of the first groove and into the second groove when the cap assembly reaches a fully closed position.

18. A child resistant container, comprising:

a container body having a central longitudinal axis, a closed base, an open top and an exterior wall; and a cap assembly configured to couple to the container body for closing the container;

wherein the cap assembly comprises a metal inner cap configured to couple to the container body and a metal outer cap coupled to the inner cap, each of the inner and outer caps having a top with a top surface and a bottom surface;

a metal plate disposed between the inner cap and the outer cap, wherein the metal plate is rotationally and axially fixed relative to the outer cap;

a first coupler coupled to the inner cap, wherein the first coupler comprises a plurality of grooves that extend radially outwardly from the central longitudinal axis, each of the plurality of grooves having sides that extend downwardly from the top of the inner cap; and a second coupler coupled to the plate and configured to optionally engage the first coupler, wherein the second coupler comprises a plurality of tongues, each of the plurality of tongues having sides that extend downwardly from the bottom surface of the metal plate;

wherein the inner cap is disposed at least partially within the outer cap and comprises a radially outwardly rolled lip that is retained within the outer cap by a radially inwardly rolled lip of the outer cap;

wherein at least a portion of the top of the outer cap is configured to optionally move among first and second positions relative to the inner cap along the central longitudinal axis, the first position being farther away from the top of the inner cap than the second position;

wherein the outer cap is configured to rotate relative to the inner cap when the top of the outer cap is in the first position and the radially inwardly rolled lip of the outer cap is in contact with the radially outwardly rolled lip of the inner cap; and wherein the second coupler is configured to engage the first coupler when the top of the outer cap is in the second position for rotationally fixing the inner and outer caps relative to one another.

19. The container of claim 18, wherein at least a portion of the sides of the plurality of tongues are disposed beneath the top surface of the top of the inner cap when the first and second couplers are fully engaged.

* * * * *